US005775155A

United States Patent [19]

Kato et al.

[11] Patent Number: 5,775,155

[45] Date of Patent: Jul. 7, 1998

[54] VARIABLE SECTION EXTRUSION DIE SET AND VARIABLE EXTRUSION MOLDING METHOD

[75] Inventors: Masatsugu Kato; Shigeo Sano, both of Tokyo; Atsushi Kamibayashi; Yasumasa Hiyoshi, both of Susono, all of Japan

[73] Assignee: Mitsubishi Aluminum Co., Ltd., Tokyo, Japan

[21] Appl. No.: 693,073

[22] PCT Filed: Jan. 10, 1996

[86] PCT No.: PCT/JP96/00019

§ 371 Date: Aug. 23, 1996

§ 102(e) Date: Aug. 23, 1996

[87] PCT Pub. No.: WO96/21528

PCT Pub. Date: Jul. 18, 1996

[30] Foreign Application Priority Data

| | | | |
|---|---|---|---|
| Jan. 12, 1995 | [JP] | Japan | 7-018798 |
| Mar. 8, 1995 | [JP] | Japan | 7-074708 |
| Mar. 8, 1995 | [JP] | Japan | 7-074709 |
| Sep. 4, 1995 | [JP] | Japan | 7-248295 |

[51] Int. Cl.[6] ..... B21C 25/08

[52] U.S. Cl. ..... 72/260; 72/468; 72/31.13; 72/377

[58] Field of Search ..... 72/20.2, 20.3, 72/21.6, 28.1, 31.13, 260, 263, 265, 266, 272, 273, 273.5, 468, 372, 377

[56] References Cited

U.S. PATENT DOCUMENTS

| | | | |
|---|---|---|---|
| 3,021,003 | 2/1962 | Bluck | 72/260 |
| 3,422,648 | 1/1969 | Lemelson | 72/260 |
| 3,585,834 | 6/1971 | De Bruyn et al. | 72/260 |
| 3,587,281 | 6/1971 | Lemelson | 72/260 |
| 3,782,154 | 1/1974 | Fuchs, Jr. | 72/19.6 |
| 5,321,967 | 6/1994 | Wakabayashi | 72/260 |
| 5,557,962 | 9/1996 | Takikawa | 72/260 |

FOREIGN PATENT DOCUMENTS

| | | | |
|---|---|---|---|
| 1063499 | 12/1983 | U.S.S.R. | 72/260 |
| 1109212 | 8/1984 | U.S.S.R. | 72/260 |
| 1189530 | 11/1985 | U.S.S.R. | 72/468 |

*Primary Examiner*—Lowell A. Larson
*Assistant Examiner*—Ed Tolan
*Attorney, Agent, or Firm*—Oblon, Spivak, McClelland, Maier & Neustadt, P.C.

[57] ABSTRACT

A molded product with a variable cross sectional configuration in the longitudinal direction is subjected to extrusion molding by using a die set for extruding a molding with a variable section in a longitudinal direction, the die set comprising a first die 10 and a second die 11, the first die 10 and the second die 11 being relatively movably disposed along the web shaping-holes 16 and 28 and arranged in order in the extruding direction of a molding material such that a first extrusion hole 14 and a second extrusion hole 30 have web shaping-holes 16 and 28 communicated with each other and a flange portion shaping-hole 15 (27) of one of the dies is situated on the side of a flange portion communication hole 29 (17) of the other die, and relatively moving the first die 10 and the second die 11 while extruding the molding material towards the variable section extrusion die set.

20 Claims, 24 Drawing Sheets

VARIABLE SECTION EXTRUSION DIE SET AND VARIABLE EXTRUSION MOLDING METHOD

TECHNICAL FIELD

This invention relates to a variable section extrusion die set and to a variable section extrusion molding method which is usable when a molding material (such as aluminum or the like) is subjected to extrusion molding, thereby forming, in particular, a molded product which varies in cross sectional shape in its longitudinal direction.

BACKGROUND ART

Recently, in various types of automotive vehicles such as common automobiles, trucks, and the like, components such as the chassis, vehicle main-frames, bumpers, and the like, which are made of aluminum or aluminum alloy, have been widely used instead of parts which are conventionally made of iron, because aluminum chassis, etc., are desirable, especially with respect to reducing the weight of vehicle main-frames, prolonging the service life of vehicles, recycling considerations, etc.

When manufacturing these types of vehicle components, it is ordinary practice to use an extrusion process. The reason for this is that the melting point of aluminum used as a raw material is low. In such an extrusion process, an extrusion die set having a hole portion which has a configuration similar in cross section to those of the vehicle components is firmly secured to a distal end portion of a container, a heated material (billet) is inserted into the interior of the container, and then the billet is pressed towards the extrusion die set side so that the former is extruded out of the hole portion, thereby forming the above-mentioned vehicle components. According to this extrusion procedure, since the hole portion of the extrusion die set has a constant cross sectional shape, the vehicle components which are thus obtained each have a constant cross sectional shape in the longitudinal direction.

It is interesting to note, however, that among the above-mentioned vehicle components, a chassis side-frame, for example, has a bending stress distribution such that a bending stress exerted thereon is large at the central area or at opposite end portions each serving as a fulcrum in the longitudinal direction, but is small at the central portion. Accordingly, when the conventional extrusion die set is used for shaping, the resultant side-frame has a constant sectional configuration in the longitudinal direction. In other words, due to a constant sectional secondary moment, the resultant side-frame tends to have an excessively large dimension and strength which are greater than necessary at the central portion. This means that some molding material is likely to be wasted, and this is therefore economically inefficient. Moreover, there are other problems such as the inability to meet the requirements for a compact installation space and a light-weight design of the vehicle components.

In an attempt to avoid the above problems, there was proposed an improved extrusion die set and extrusion molding method in Japanese Patent Application Laid-Open No. 31527/93, as shown in FIG. 33 of the attached drawings of the present application.

An extrusion die set according to the teaching of the above Laid-Open Publication comprises a stationary die 1 secured to a container and a movable die 2 which can move relative to the stationary die 1. The stationary die 1 includes a first die hole 3 which defines a web, a second die hole 4 extending at right angles from an upper end of the first die hole 3 to define a flange, and a third die hole, similarly extending at right angles, but from a lower end of the first die hole 3. The third die hole 5 is equal in length to, but is larger in width than, the second die hole 4. In contrast, the movable die 2 includes a first movable die hole 6 which communicates with the first die hole 3, and a second die hole 7 which communicates with the third die hole 5 and defines another flange.

According to an extrusion die set which is constructed in this manner, by appropriately moving the movable die 2 in directions as indicated by a two-headed arrow in FIG. 33, the length of the web of a component to be shaped can be varied in the longitudinal direction of the component through the first die hole 3 and the first movable die hole 6. Accordingly, this conventional technique has an advantage in that there can be formed a component which has a large bending strength at the central portion, but has a small bending strength at opposite end portions in the longitudinal direction, for example.

However, the above conventional extrusion die set and extrusion molding method have the following disadvantages. In the produced component, flanges which each have a constant width are formed on the upper end portion and the lower end portion of the web over the entire length thereof in the longitudinal direction. Accordingly, a change of the length of only the web is not sufficient to extensively vary the sectional secondary moment in the longitudinal direction. Moreover, when this component is to be installed on a vehicle main frame or the like, those parts of the flanges at the opposite ends of the web, which are unnecessary or which are likely to interfere with other members, must be cut off, and therefore, much time and labor are required after the completion of a molding operation.

The present invention has been accomplished in order to effectively solve the problems inherent in the conventional extrusion die set and an extrusion molding method using this die set. It is, therefore, an object of the present invention to provide a variable section extrusion die set and a variable section extrusion molding method, in which when a molding material such as aluminum is to be extruded, a part can be formed by arbitrarily varying the length in the longitudinal direction of the web, the existence or non-existence of flanges, the width, etc.

Another object of the present invention is to provide a variable section extrusion die set and a variable section extrusion molding method using the die set, in which molding resistance can be reduced and molding accuracy can be improved by enhancing a smooth flow of the molded material and decreasing possible distortion of the resultant product.

A further object of the invention is to provide a variable cross section extrusion molding method in which a control system is employed so that the shape in the length of a molded object can be controlled with a simple construction during an extrusion process for a molded material, thereby enabling extrusion molding of a variable cross section structural member with a high degree of dimensional accuracy.

DISCLOSURE OF INVENTION

A variable section extrusion die set according to the invention as defined in claim 1 comprises a first die and a second die; the first die having a first extrusion hole formed therein, the first extrusion hole including a flange portion shaping-hole having a width equal to a maximum thickness of one of the flanges, a web shaping-hole extending in a direction crossing to the flange portion shaping-hole, and a flange portion communication hole formed in the other end portion of the web shaping-hole and having a larger width than the flange portion shaping-hole; the second die having a second extrusion hole formed therein, the second extrusion hole including a flange portion shaping-hole having a width equal to a maximum thickness of another flange, a web shaping-hole extending in a direction crossing to the flange portion shaping-hole, and a flange portion communication hole formed in the other end portion of the web shaping-hole and having a larger width than the flange portion shaping-hole; the first and second dies being arranged in this order in an extrusion direction of a molded material and relatively movable along the web shaping-holes, respectively, such that the web shaping-holes of the first and second extrusion holes are in communication with each other and the flange portion shaping-hole of one of the first and second dies is disposed on the side of the flange portion communication hole of the other die.

The invention as defined in claim 2 is constructed such that the first die is formed therein with a hole portion extending parallel to the web shaping-hole and in a direction crossing to an extrusion direction of a molding material, and the second die is slidably inserted into the hole portion; whereas the invention as defined in claim 3 is constructed such that ends in the thickness direction of the first and second dies are each formed with a bearing portion, the bearing portion having a thin wall and defining a contour of each of the opening portions, the first and second dies being further provided respectively with recesses extending from the bearing portions towards the other ends and having a larger inside diameter than the bearing portions, the first and second dies being arranged such that the bearing portions are disposed adjacent with each other.

Similarly, a variable section extrusion die set as defined in claim 4 comprises a first die, a second die, and a third die; the third die being movable in a direction crossing to a relative movement direction of the first and second dies and adapted to adjust a maximum width in a direction crossing to the relative movement direction, the first die being formed therein with a first extrusion hole as the opening portion, the first extrusion hole including a flange portion shapinghole having a width equal to a maximum thickness of one of the flanges, a web shaping-hole extending in a direction crossing to the flange portion shaping-hole, and a flange portion communication hole formed in the other end portion of the web shaping-hole and having a larger width than the flange portion shaping-hole, the second die being formed therein with a second extrusion hole as the opening portion, the second extrusion hole including a flange portion shaping-hole having a width equal to a maximum thickness of the other flange, a web shaping-hole extending in a direction crossing to the flange portion shaping-hole, and a flange portion communication hole formed in the other end portion of the web shaping-hole and having a larger width than the flange portion shaping-hole, the first and second dies being relatively movable along the web shaping-holes, respectively, such that the web shaping-holes are in communication with each other and the flange portion shaping-hole of one of the first and second dies is situated on the side of the flange portion communication hole of the other die, the third die being disposed outwardly of a distal end in a longitudinal direction of the flange portion shaping-hole and slidable in the longitudinal direction.

Here, the invention as defined in claim 5 is characterized in that the third die is disposed outwardly of at least one of opposite ends in the longitudinal direction of the flange portion shaping-hole; whereas the invention as defined in claim 6 is characterized in that the first die is provided with a hole portion extending parallel to the web shaping-holes and in the direction crossing to the extrusion direction of the molding material and a groove portion extending parallel to the web shaping-holes and in the direction crossing to the extrusion direction of the molding material, the second die being slidably inserted into the interior of the hole portion, the third die being slidably inserted into the interior of the groove portion.

Further, the invention as defined in claim 7 is characterized in that the first and second extrusion holes according to one of claims 1 through 6 are identical in form with each other at least at the flange shaping-holes and web shaping-holes, and are symmetrical with each other with respect to lines parallel to extensions of the flange portion shaping-holes, respectively; whereas the invention as defined in claim 8 is characterized in that the web shaping-holes are each formed in a central portion of an extension of each of the flange portion shaping-holes.

Next, a variable section extrusion molding method according to the present invention as defined in claim 9 comprises, with the use of a variable section extrusion die set of claim 1, the steps of relatively moving the first and second dies while extruding the molding material towards the variable section extrusion die set, an extruding operation being performed at least at two or more of the following positions: a first position where the web shaping-holes of the first and second extrusion holes being in communication with each other and the flange portion shaping-holes being not in communication with the flange portion communication hole of the other die, a second position where the web shaping-holes of the first and second extrusion holes being in communication with each other and a part of one of the flange portion shapinghole being in communication with the other flange portion communication hole, and a third position where the web shaping-holes of the first and second extrusion holes being in communication with each other and an entirety of one of the flange portion shaping-holes being in communication with the other flange portion communication hole, thereby extruding a molded article which varies in cross sectional configuration in the longitudinal direction.

Similarly, the invention as defined in claim 10 is characterized in that with the use of the variable section extrusion die set of claim 4 and using the extrusion processing of claim 9, a length of each of the flange portion shaping-holes is adjusted by the third die, thereby extruding a molded article which varies in cross sectional configuration in the longitudinal direction.

Furthermore, the invention as defined in claim 11 relates to a variable section extrusion molding method for producing a molded object which varies in cross sectional area in an extruding direction by varying an opening area of a die hole using a variable means, while extruding a molding material, the molding material having been fed into a container by a pressing means; the method characterized by comprising the steps of preliminarily establishing a rate of variation of the opening area of the die hole with respect to the length of the molding and an amount of extrusion of the molding material by the pressing means to control means, and controlling, by the control means, an amount of variation of the opening area caused by the variable means so that the length of extrusion of the molding and the opening area corresponds to an amount of movement of the pressing means, while detecting the amount of movement when the extrusion molding is performed.

At that time, the invention as defined in claim 12 is characterized in that the pressing means is a ram for pressing the molding material; a variation equation, $A=f(z)$, of the opening area A against a sectional area D of the container and a length z of the molding is preliminarily input to the control means, and then an amount of variation of the opening area by means of the variable means is controlled by the control means so that the molding is controlled to have an extrusion length dz and an area A corresponding to the dx calculated based on $D \cdot dx=f(z) \cdot dz$ and an area A by the control means in response to a detection signal of a movement dx of the ram from x.

In the invention as defined in claim 1 and in the invention as defined in claim 9 using the invention of claim 1, first, the first die and the second die are moved relative to each other so that the web shaping-holes of the first and second extrusion holes are brought into communication with each other and one flange portion shaping-hole and the other flange portion shaping-hole are brought into a non-communicating position with each other. When the molding material is extruded in that position, a component having only a flat barlike web is molded. At that time, the first and second dies are moved along the web shaping-holes while maintaining the above-mentioned state, thereby enabling the variation of the length of the web in the component in the longitudinal direction.

Subsequently, the first and second dies are moved relatively further so that the web shaping-holes of the first and second extrusion holes are brought into communication with each other and a part of one flange portion shaping-hole and the other flange portion shaping-hole are also brought into communication with each other. When the molding material is extruded in that position, the above-mentioned component having flanges of a thickness corresponding to the part of the flange shaping-hole on opposite end portions of the web is molded. At that time, the first and second dies are moved along the web shaping-holes while maintaining the above-mentioned state, thereby enabling the appropriate change of the thickness of the flanges in the component in the longitudinal direction.

Then, the first and second dies are moved relatively further so that the web shaping-holes of the first and second extrusion holes are brought into communication with each other and an entirety of one flange portion shaping-hole and the other flange portion shaping-hole are also brought into communication with each other. When the molding material is extruded in that position, the above-mentioned component having flanges of a maximum thickness on opposite end portions of the web is formed. Here, the first and second dies are moved further along the web shaping-holes while maintaining the above-mentioned state, thereby enabling the variation of the length of the web between the flanges. When the second die is moved further, a component having a rib formed on its central portion is formed. When the second die is kept moving on, a square rod can finally be molded.

Accordingly, by appropriately varying the relative position between the first and second dies in the above-mentioned positional relations, a component can easily be formed having various cross sectional configurations in the longitudinal direction, such as the portion having only the web of an appropriate length, the portion having flanges of appropriate thickness formed on the opposite end portions of the web, and the portion having flanges of the maximum thickness formed on the opposite end portions of the web and formed with the web having an appropriate length.

Here, when a bending stress acts on the component, if the micro sectional area at a distance z from its neutral axis is represented by dA, the sectional secondary moment $I=\int_A z^2 dA$. Accordingly, as is known, the presence or absence of the flanges yields a significant effect on the value of the sectional secondary moment. In this respect, according to the invention as defined in claim 1, the component can be molded by freely selecting the present or absence of the flanges and the thickness thereof in the longitudinal direction. As a consequence, the bending strength of the component can be adjusted over a wide range. Moreover, the portion formed of only the web can be preliminarily formed on an area where no flanges should be formed at the time of extrusion molding. Accordingly, there is no need for the time and labor for cutting off unnecessary flange portions at a later processing stage.

At that time, as in the invention of claim 2, if the second die is slidably inserted into the interior of the hole portion formed in the first die, the second die can be stably and slidably held with respect to the first die, and therefore molding accuracy of the molded material can be enhanced.

According to the invention as defined in claim 3, since the molded material is fed into the extrusion shaping-holes which are formed by the bearing portions, friction resistance between the shaping-holes and the extrusion shaping-holes is reduced. Furthermore, since the bearing portions of the first and second dies are continuous with each other, positional displacement in the extruding direction is reduced between a processing point by the first die and another processing point by the second die.

In addition, according to the invention of claim 4 or 5 and according to the invention of claim 10 using the invention of claim 4 or 5, the width and length of the flanges can be freely selected in the longitudinal direction of the component material in extrusion molding, and therefore the bending strength of the component can be adjusted over a wide range. Moreover, since the extrusion molding can be performed while appropriately adjusting the length of the flanges, it can easily be made at the time of extrusion molding that the length of the flanges is locally reduced and the flanges are cut out. Thus, there is no need for the time and labor for cutting off unnecessary flange portions at a later processing stage.

At that time, as in the invention of claim 6, if the second and third dies are slidably inserted respectively into the hole portion and the groove portion formed in the first die, the second and third dies can be stably and slidably held with respect to the first die, and therefore molding accuracy of the component can be enhanced.

Also, as in the invention of claim 7, if at least the flange portion shaping-hole and the web shaping-hole of the first and second extrusion holes are formed to have identical configurations with each other, a component, which is vertically or horizontally symmetrical, can be extruded in the same manner as described above. Also, as in the invention of claim 8, if the web shaping-hole is formed in the central portion in the extending direction of the flange portion shaping-hole, an H-shaped member generally used as a reinforcing member such as a side-frame, in particular, can be extruded.

Furthermore, according to the variable cross section extrusion molding method as defined in claim 11, first, a rate of variation of the opening area of the die hole with respect to the length of the molding and an amount of extrusion of the molding material from the pressing means are preliminarily set by the control means, and an amount of variation of the opening area caused by the variable means is controlled by the control means such that the length of extrusion of the molding and the opening area corresponds to an amount of extrusion (volume) of the molding material with the passage of time; this amount is determined by the amount of movement of the pressing means, while detecting the amount of movement when the extrusion molding is performed. Accordingly, the configuration of the molding with respect to the length thereof can be easily controlled during the extruding operation of the molding material without directly measuring the extrusion length of the molding. As a consequence, a component having a variable section can be extruded with a high degree of precision.

Acceptable examples of the position detection means may include a pulse generator and an optical sensor, which are generally used for measuring velocity. As the control means, an arithmetic processor such as a small personal computer can be used. Accordingly, the above-mentioned control operation can be performed without any substantial changes to the conventional extrusion molding apparatus and with a minor change of equipment added thereto.

It should be noted that the invention as defined in claim 12 is one embodiment of the invention of claim 1. Operation by the control means in this embodiment will now be described specifically. First, as shown in FIG. 32, an expression of change A=f(z) of the opening area A versus the length z in the structural member to be molded is obtained. Then, the sectional area D, the expression of change A = f(z) of the opening area A versus the length z of the molding, and an expression of relation between this expression of change and the control amount of the variable means, are preliminarily input into the control means.

Here, the volume of the extruded molding material by dx movement of the ram is dV=D·dx. On the other hand, presuming that a molding of a length dz is extruded from the die hole while the opening area A is varied by the dx movement of the ram, the volume of the extruded molding is dV =f(z)·dz. Thus, the following equation can be made.

$$D \cdot dx = f(z)dz \quad (1)$$

Accordingly, the length $\Delta z$ of the molding formed when the molding is extruded from $z_0$ to $z_1$ in such a manner as to correspond to the$\Delta x$ movement from $x_0$ to $x_1$ can be expressed by the following equation:

$$D \cdot \Delta x = F(z_1) - F(z_0) \quad (2)$$

and this equation can be obtained by differentiating both sides of equation (1) with respect to the respective ranges. It should be noted that $F(z)=\int f(z)dz$. In the equation (2), the equation A=f(z) and the values of D and $z_1$ are known. Accordingly, when the extrusion molding is performed, the amount of movement of the ram is detected. At the point in time when the ram is moved to $\Delta x$, which has been set by the control means, the amount of variation of the opening area is controlled by the variable means of the control unit such that the molding will have an extrusion length $\Delta z$ and an area $f(z_1)$ corresponding to the above-mentioned $\Delta x$ obtained by calculation based on the equation (2), thereby enabling to the performance of an extrusion molding of a molded object having a predetermined variable sectional configuration.

At that time, if $\Delta x$ is set to a value small enough in comparison to the rate of variation of the opening area A, an average value $\{f(z_1) - f(z_0)\}/2 = fm$ can be used as the opening area of the die hole. Therefore, the equation (2) can be rewritten in the following simple style.

$$D \cdot \Delta x = fm \cdot \Delta z \quad (3)$$

Thus, $\Delta z = \Delta x \cdot R$ (where R=D/fm: ratio of extrusion). Accordingly, by calculating the ratio of extrusion between the specific$\Delta x$, there can be obtained$\Delta z$ corresponding to $\Delta x$. For this reason, the arithmetic processing by the control means becomes much easier and this is very favorable.

BRIEF DESCRIPTION OF THE DRAWINGS

FIG. 23(*a*) is a view showing an exploded view;

FIG. 23(*b*) is a view showing an assembled state;

BEST MODE FOR CARRYING OUT THE INVENTION

First Embodiment

FIGS. 1 through 6 show one embodiment, in which a variable cross section extrusion die set (hereinafter simply referred to as an "extrusion die set") according to the present invention is applied to an extruder for extruding an H-shaped member which has in a portion thereof a flangeless portion.

Figure 1:
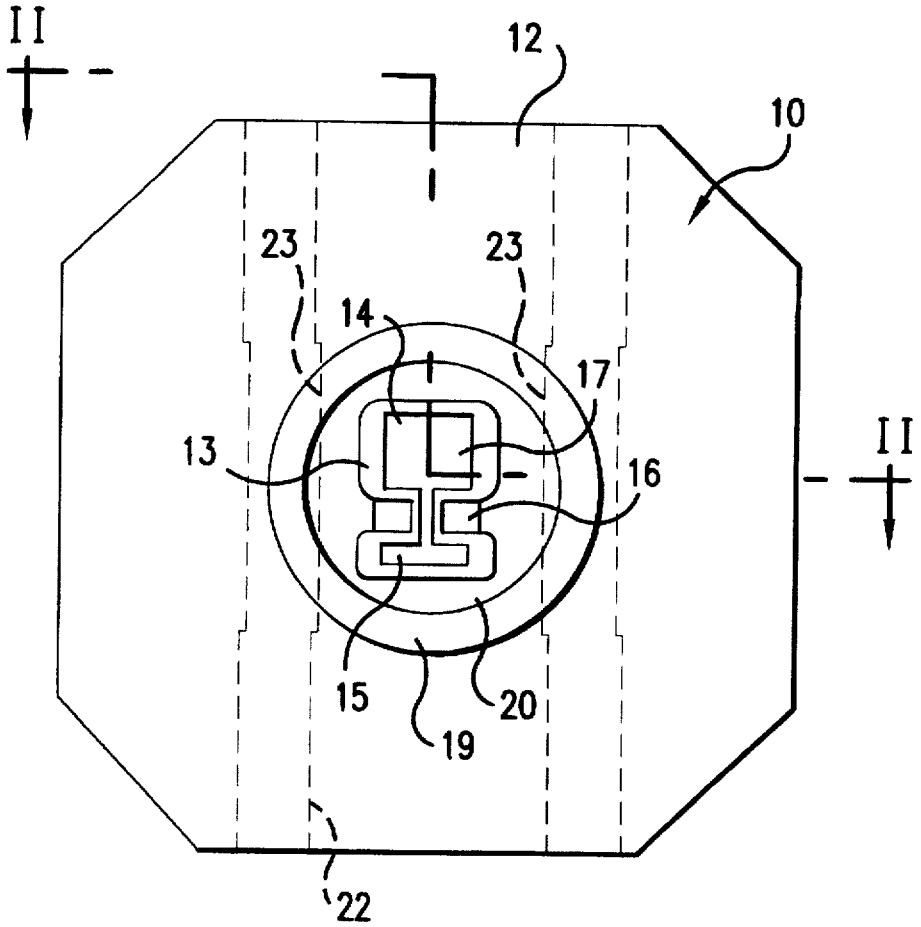
FIG. 1 is a plan view showing a first die in a first embodiment of a variable section extrusion die set according to the present invention.
Figure 2:
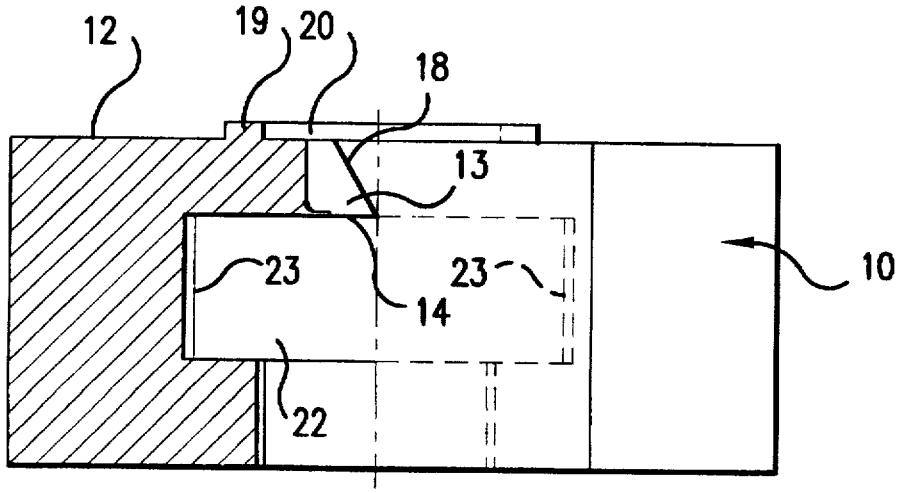
FIG. 2 is a sectional view taken along line II—II and viewed in the direction indicated by arrows in FIG. 1.

In these Figures, the extrusion die set comprises a first die 10 and a second die 11. As shown in FIGS. 1 and 2, the first die 10 is a member having an outer appearance of a generally square plate-like shape formed by a hot tool steel. A recess 13 which serves as a flow path of a molding material extruded from a container (not shown) is formed in a central area of an upper surface 12 of the first die 10; the upper surface 12 is situated on the container side. A first extrusion hole 14 is formed in a bottom portion of the recess 13.

The first extrusion hole 14 includes a flange portion shaping-hole 15 having a width equal to a maximum thickness of one of the flanges in the components such as a side-frame or the like which are to be formed or molded, a web shaping-hole 16 extending in a direction perpendicular to a central portion of the flange portion shaping-hole 15, and a flange portion communication hole 17 formed in the other end portion of the web shaping-hole 16. Here, the flange portion communication hole 17 has a length equal to that of the flange portion shaping-hole 15, and a width larger than that of the flange portion shaping-hole 15.

An inclined surface 18 for guiding the molding material smoothly into the web shaping-hole 16 is formed in a side wall of the recess 13; the side wall is located on both sides of the web shaping-hole 16. A round-shaped stepped-portion 19 is also formed on the central portion of the upper surface 12. The round-shaped stepped-portion 19 projects from the central portion of the upper surface 12 to fit on a lower surface of the container. A guide hole 20 having an enlarged diameter and adapted to intercommunicate the interior of the container and the recess 13 is formed in a central portion of the stepped-portion 19.

A hole portion 22 extending parallel to the web shaping-hole 16 and between the side surfaces is formed in a central portion of each side surface of the first die 10. The hole portion 22 is in communication with the first extrusion hole 14. A pair of opposing guide walls 23 for intimately and slidably guiding side surfaces of the second die 11 is formed on the side surface central portions of the hole portion 22, respectively. Within the hole portion 22 of the first die 10, the second die 11 is slidably disposed as shown in FIG. 4.

Figure 3:
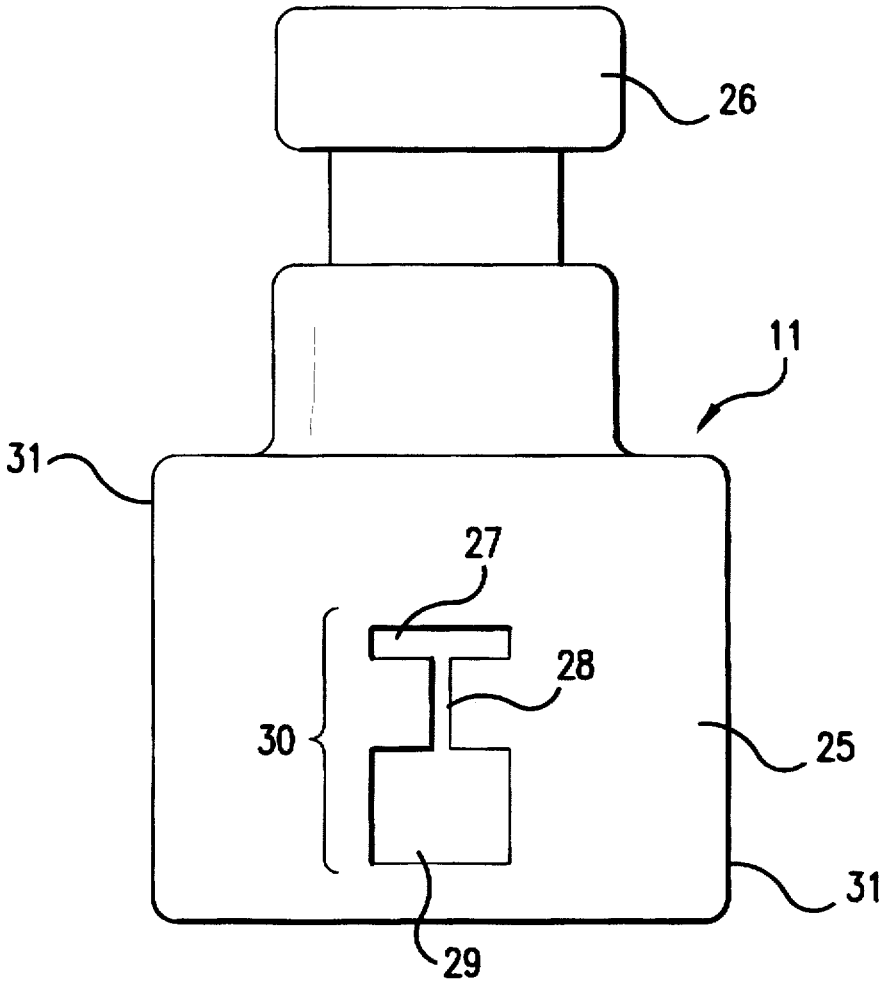
FIG. 3 is a plan view showing a second die in the first embodiment of the present invention.

As shown in FIG. 3, the second die 11 is integrally constituted of a head portion 25 inserted into the hole portion 22, and a clamp portion 26 which is connected with a drive means such as a hydraulic cylinder or the like, so as to cause the head portion 25 to slide within the hole portion 22. The head portion 25 is a member having an outer appearance of a generally square plate-like shape formed by a hot tool steel or the like. A second extrusion hole 30 including a flange portion shaping-hole 27 having a dimension equal to that of the first extrusion hole 14, a web shaping-hole 28 extending in a direction perpendicular to a central portion of the flange portion shaping-hole 27, and a flange portion communication hole 29 formed in the other end portion of the web shaping-hole 28. Here, the web shaping-hole 28 is parallel relative to the side-walls 31 of the second die 11.

Figure 4:
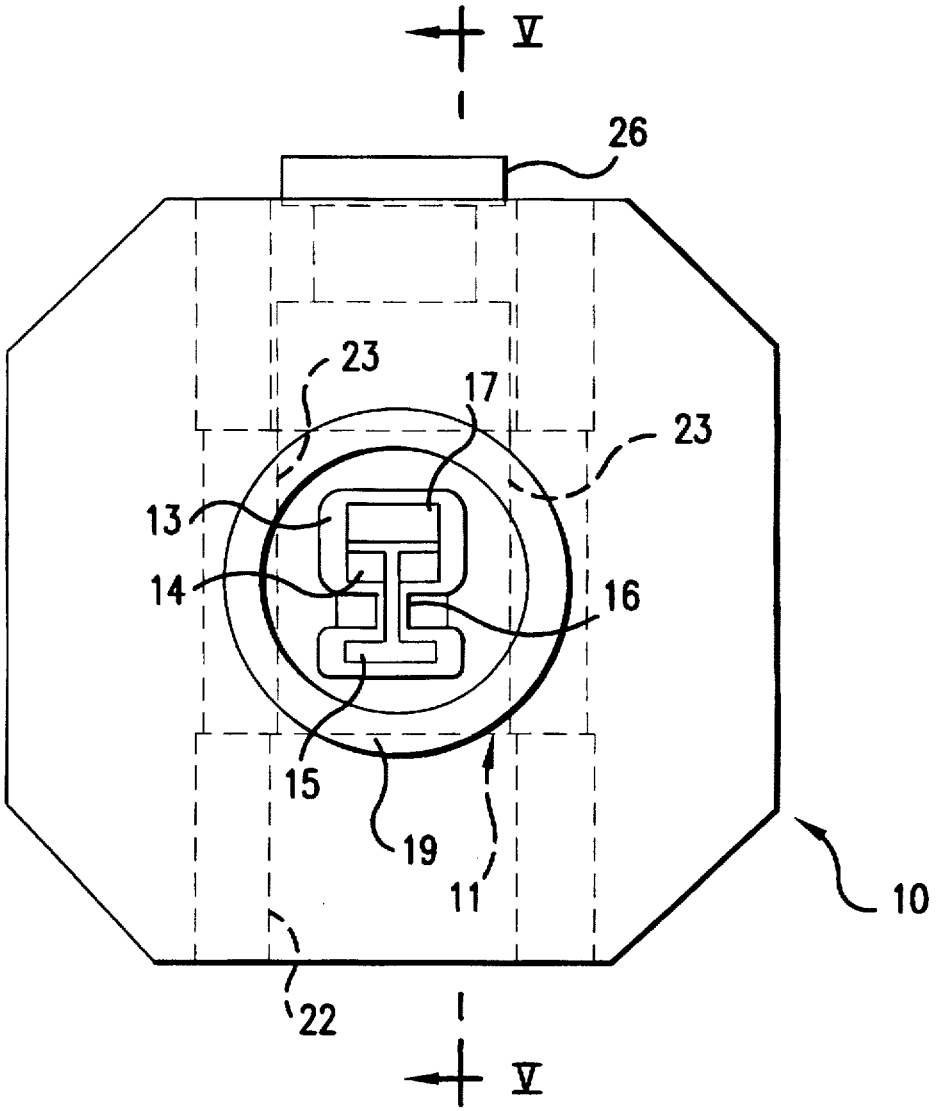
FIG. 4 is a plan view showing a combined state of the first die of FIG. 1 with the second die of FIG. 3.

As shown in FIG. 4, the second die 11 is slidably inserted into the hole portion 22 of the first die 10 along the guide surfaces 23 within the hole portion 22 of the first die 10 so that the flange portion shaping-hole 27 is situated on the side of the flange portion communication hole 17 of the first extrusion hole 14; in other words, the flange portion shaping-hole 27 is symmetrical with the flange portion communication hole 17 with respect to a line parallel with an extension of the flange portion shaping-hole 15. As a result of this arrangement, the first extrusion hole 14 and the second extrusion hole 30 are arranged in order in the extruding direction of the molding material.

Figure 5:
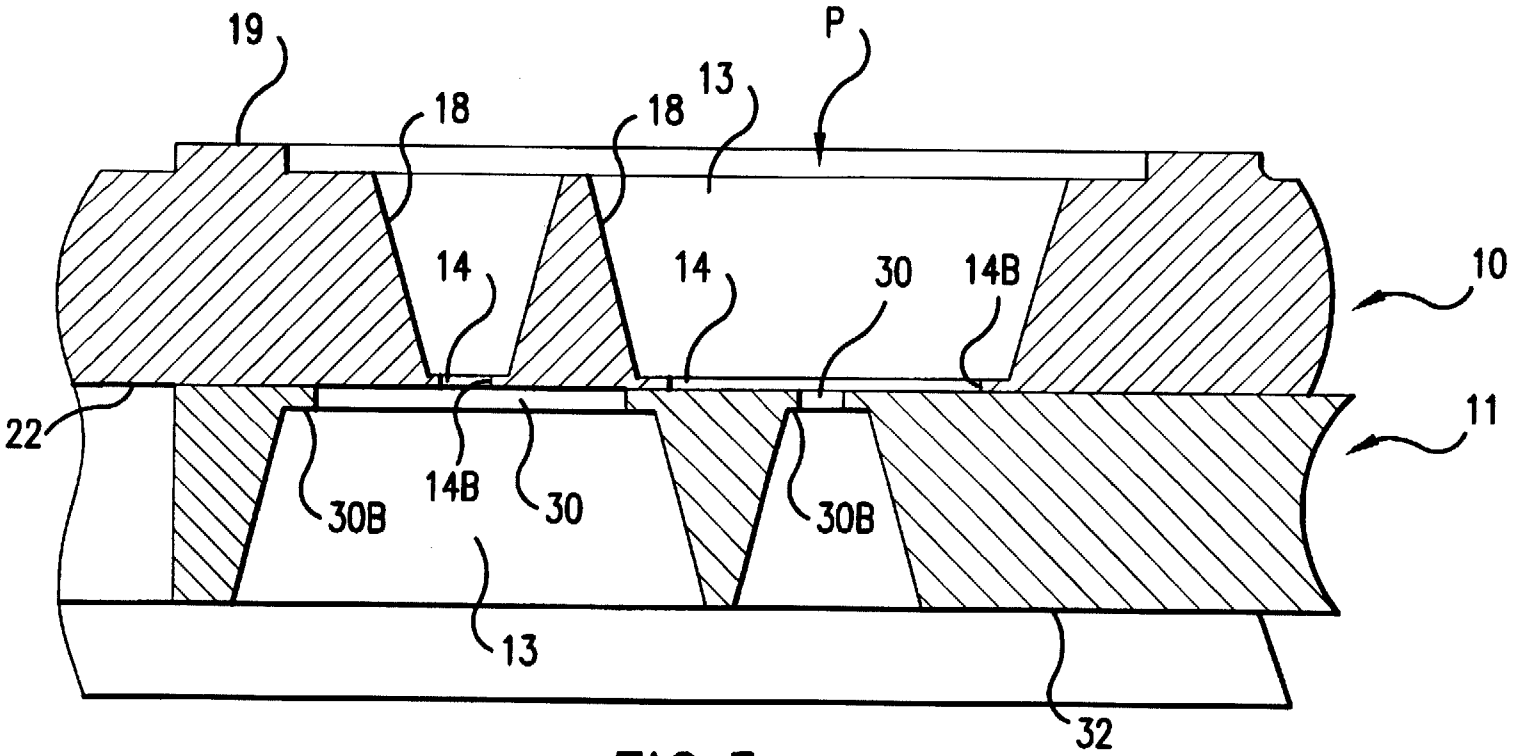
FIG. 5 is a sectional view taken along line V—V and viewed in the direction indicated by arrows in FIG. 4.

Here, as shown in FIG. 5, a thin bearing portion 14B defines a contour of an opening portion of the first extrusion hole 14 at the bottom portion of the recess 13 of the first die 10. As a result of this arrangement, the first die 10 is arranged so that the bearing portion 14B is situated at an end portion in a direction of the wall thickness of the first die 10 (i.e., at an end portion on the downstream side in an extruding direction P).

Another recess 13 having an identical configuration as that of the second die 11, and serving as a release portion, is formed at a central portion of a wall surface 32 on the down stream side in the extruding direction of the second die 11. The second extrusion hole 30 is formed in a bottom wall of the recess 13. The contour defining the opening portion of the second extrusion hole 30 is defined by a thin bearing portion 30B which forms the bottom wall of the recess 13. The bearing portion 30B is positionally offset toward the end portion in the direction of the wall thickness of the second die 11, i.e., offset toward the end portion on the upstream side of the extruding direction P. Accordingly, in the combined state of the first die 10 and the second die 11, the bearing portion 14B and the bearing portion 30B are adjacent to each other.

Figure 6:
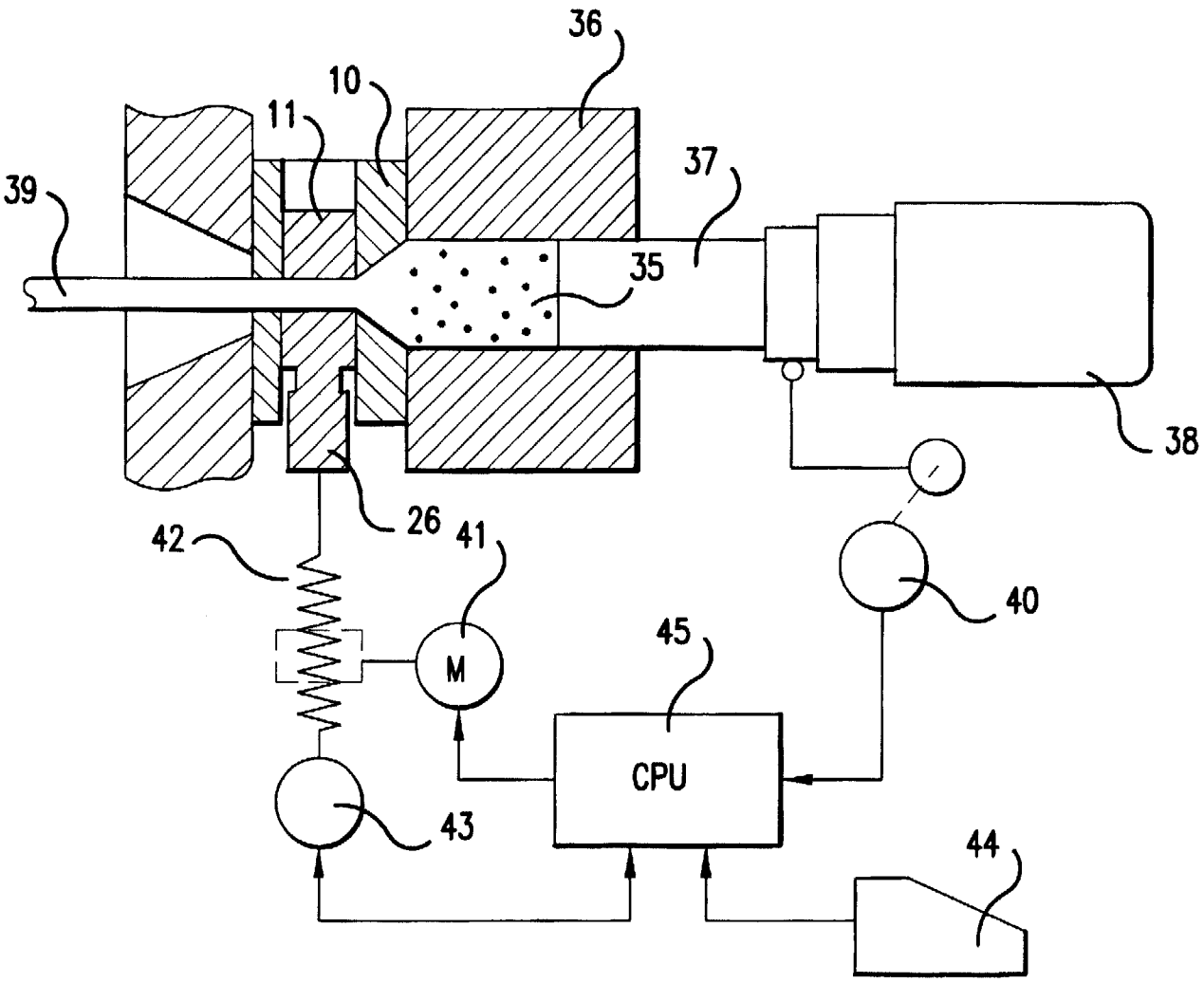
FIG. 6 is a schematic view of a construction of an extrusion molding together with the variable section extrusion die set.

The extrusion die set thus constructed is installed, as shown in FIG. 6, at a distal end portion of a container 36 of an extrusion molding apparatus which comprises the container 36 in which a molding material 35 (such as aluminum) is stored, and an extruder cylinder (pressing means) 38 disposed on a basal end portion of the container 36 and adapted to press the molding material 35 contained in the container 36 towards the distal end side by a ram 37, so that the molding material 35 extruded by the ram 37 is formed into a configuration of the molding. The clamp portion 26 of the second die 11 is connected with a geared motor 41 for varying the area of the die hole by moving the clamp portion 26 in a direction perpendicular to the extruding direction and a screw jack 42 for driving the same. The variable means of the extrusion die set is constituted by the geared motor 41 and the screw jack 42.

The extrusion molding apparatus further includes a control system for smoothly performing a variable extrusion molding operation.

Specifically, the ram 37 of the extrusion molding apparatus is provided with a pulse oscillator (position detection means) 40 for detecting a moving amount dx in the pressing direction. On the other hand, the screw jack 42 is attached with a pinion and rack mechanism, not shown. Another pulse oscillator 43 for detecting the position of the screw jack 42 is mounted on the pinion. This control system further comprises a control unit (control means) 45. In response to a detection signal from the pulse oscillator 40, the control unit 45 calculates an extrusion length of the molding corresponding to the extrusion amount of a molding material 39 in the moving distance of the ram 37 and the opening area based on various control data such as an extrusion length of the molding, a rate of variation of the opening area, a diameter of the sectional area of the container, and the like, and these data are preliminarily input from a data input terminal console 44, and thereby controls the geared motor 41 to move the second die 11. Positional data of the second die 11 coming from the pulse oscillator 43 are fed back to the control unit 45.

A method for extruding a component, such as a side-frame made of aluminum or aluminum alloy, using an extrusion die set thus constructed, will now be described with reference to FIGS. 7 through 15.

Figure 7:
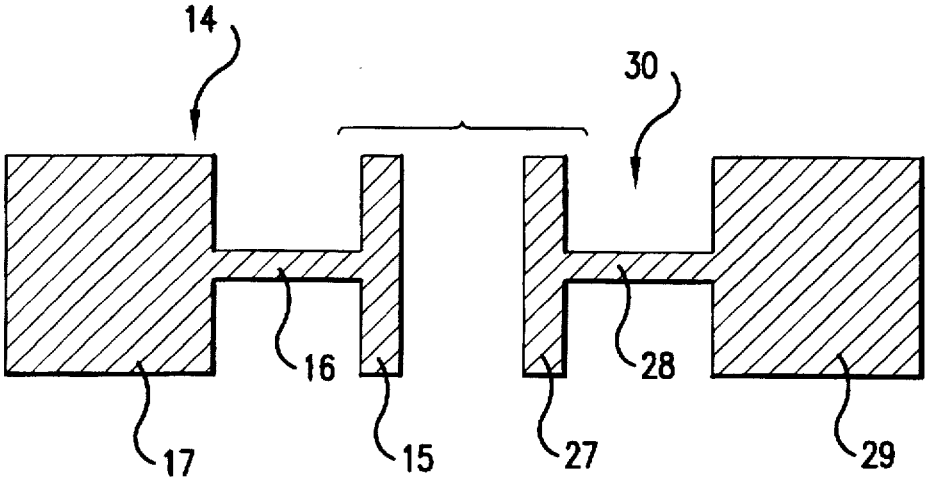
FIG. 7 is a plan view showing the shapes of the first and second extrusion holes of FIGS. 1 through 3.

The portion indicated by hatching of FIG. 7 shows the configuration of the second extrusion hole 30. FIGS. 8 through 15 show various positional relationships between the first extrusion hole 14 and the second extrusion hole 30. In FIGS. 8 through 15, for example, the portion, on which two-differently-oriented hatchings are overlapped with each other, shows the sectional configuration of the component which can be obtained by extrusion.

Figure 8:
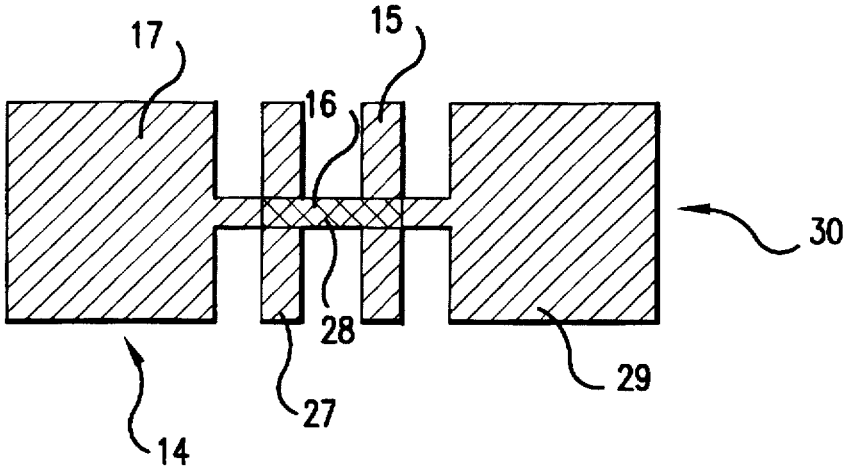
FIG. 8 is a plan view showing a state in which only a web is molded by the first and second extrusion holes of FIG. 7.

First, as shown in FIG. 8, the geared motor 41 is driven to cause the second die 11 to slide on the guide surfaces 23 within the hole portion 22 of the first die 10 so that the web shaping-holes 16 and 28 between the first extrusion hole 14 and the second extrusion hole 30 are brought into communication with each other, while one the flange portion shaping-holes 15 and 27 and the flange portion communication holes 17 and 29 are held in non-communicated position. In this state, an aluminum or aluminum alloy is extruded as a molding material. Since the molding member is, as a matter of course, extruded passing through only the communicating portions of the web shaping-holes 16 and 28, a planar component having only a flat bar-like web corresponding to the length of the communicated portions is formed.

At this time, while maintaining the above-described state, the second die 11 is moved to vary the length of the communicating portions of the web shaping-holes 16 and 28, so that the length of the web in the component can be varied in the longitudinal direction. The length of the web becomes maximum at the position of FIG. 9.

Figure 10:
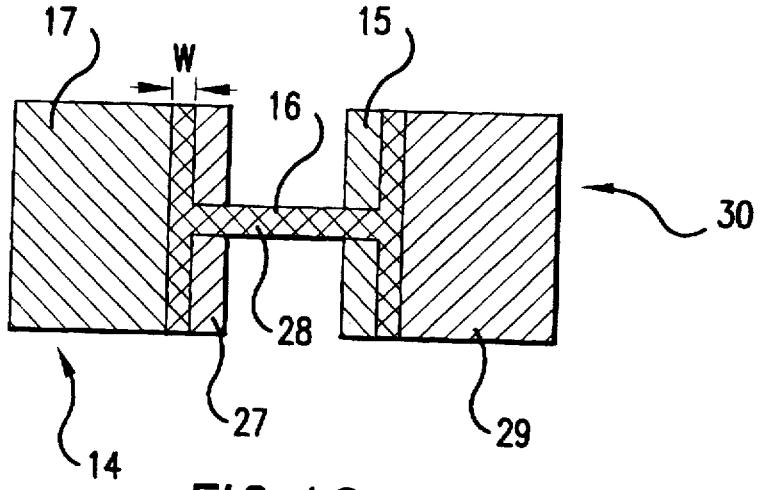
FIG. 10 is a plan view showing a state in which the web and flanges are molded by the first and second extrusion holes of FIG. 1 and 2.

Then, as shown in FIG. 10, the second die 11 is further moved towards the interior of the first die 10, so that parts of shaping-holes 15 and 27 of one flange portion are brought into communication with the flange portion communication holes 17 and 29. In that position, the molding material is extruded. As a consequence, an H-shaped component, having a flange of a thickness W corresponding to the communicating portions between the flange portion shaping-holes 15 and 27 and the flange portion communication holes 17 and 29, is formed on each of opposite end portions of the web. While maintaining the above-described state, the second die 11 is moved so that the thickness W of the flange in the component can be appropriately varied in the longitudinal direction.

Figure 11:
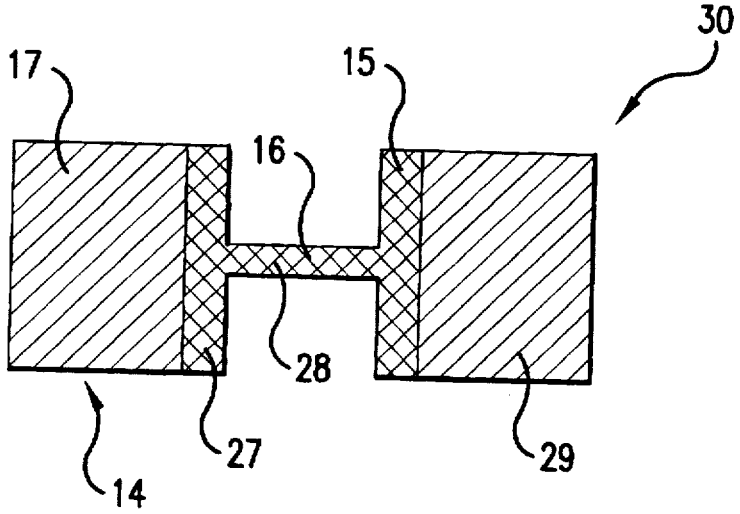
FIG. 11 is a plan view showing a state in which the flanges of FIG. 10, the flanges having the maximum width, are molded.

As shown in FIG. 11, the second die 11 is further moved so that shaping-holes 15 and 27 of one flange portion of the first extrusion hole 14 and the second extrusion hole 30 are brought into full communication with the communication holes 17 and 29 of the other flange portion, respectively. In that position, when the molding material is extruded, an H-shaped component having a flange of maximum width is formed on each of the opposite end portions of the web. While maintaining the above state, the second die 11 is moved along the guide surfaces 23 of the second die 11, so that the length of the web between the flanges can be gradually increased as shown sequentially in FIGS. 12 and 13. When the second die 11 is further moved, a component having a rib at its central portion is formed as shown in FIG. 14. When the second die 11 continues to be moved, a square rod can finally be formed as shown in FIG. 15.

Figure 9:
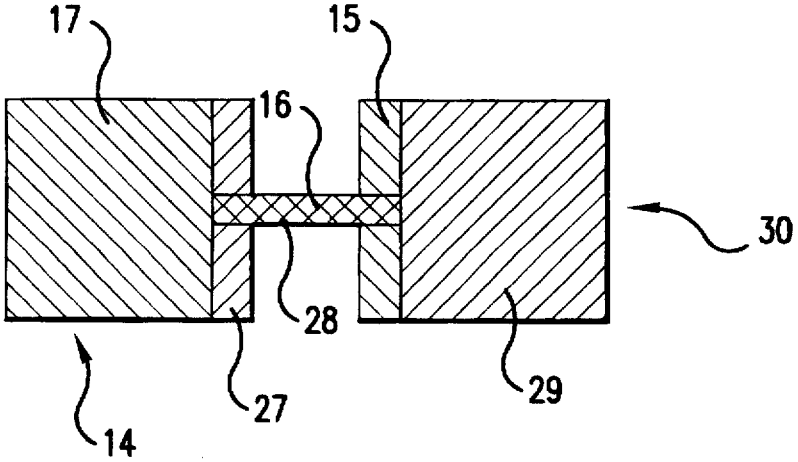
FIG. 9 is a plan view showing a state in which the second extrusion hole of FIG. 8 is further moved.
Figure 12:
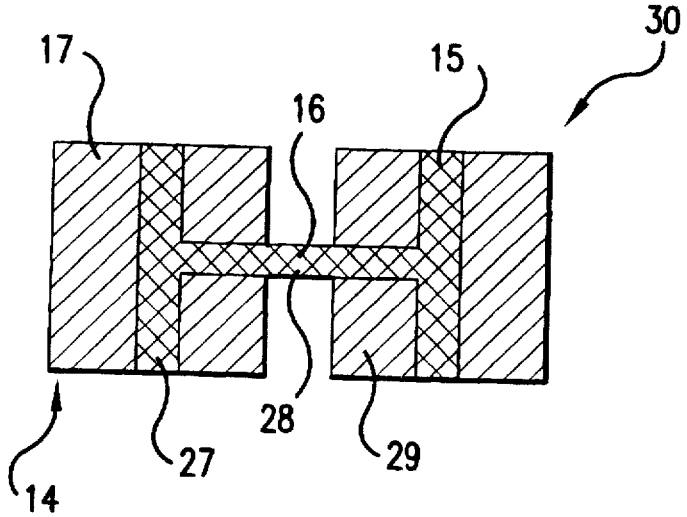
FIG. 12 is a plan view showing a state in which the length of the web is expanded by moving the second extrusion hole of FIG. 11.
Figure 13:
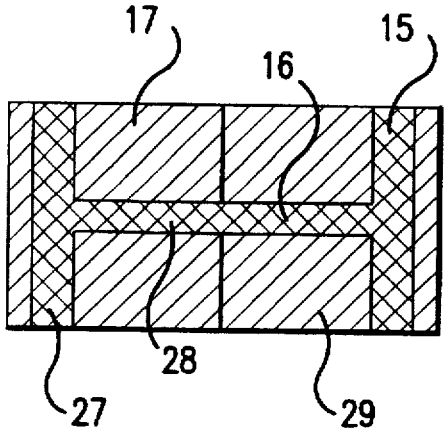
FIG. 13 is a plan view where the length of the web is expanded to its maximum extent by moving the second extrusion hole of FIG. 12.
Figure 14:
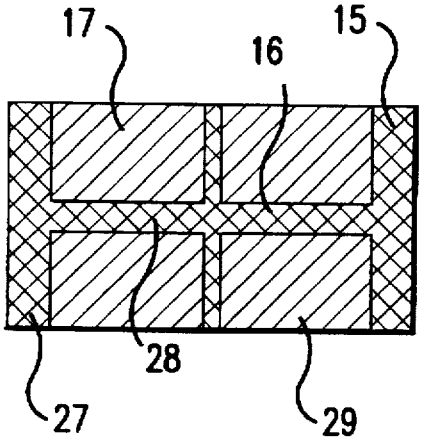
FIG. 14 is a plan view showing a state in which a rib is formed on a central portion by moving the second extrusion hole of FIG. 13.
Figure 15:
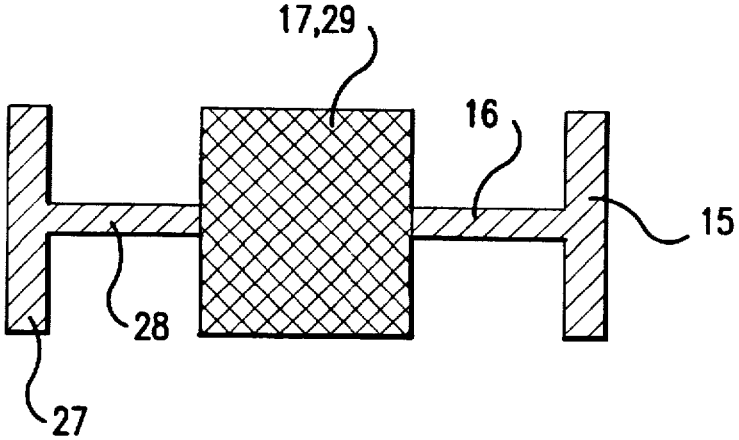
FIG. 15 is a plan view showing a state in which a square rod-shape portion is shaped by further moving the second extrusion hole of FIG. 14.

Accordingly, in the above-described extrusion die set, by appropriately varying the relative position between the first and second dies in the above-mentioned positional relations, there can easily be formed a component having various sectional configurations in the longitudinal direction, such as the flat-plate like portion only of a web having an appropriate length as shown in FIGS. 8 and 9, the H-shaped portion with the flanges having an appropriate thickness W formed on the opposite end portions of the web as shown in FIG. 10, the H-shaped portion having flanges of maximum thickness formed on the opposite end portions of the web and formed with the web having an appropriate length as shown in FIGS. 11 through 13, the portion having the rib formed on the central portion as shown in FIG. 14, and finally, the square rod-like portion as shown in FIG. 15.

In this case, according to the above-mentioned extrusion die set, the flangeless planar portion formed of only the web having an appropriate length, the H-shaped portion having the flanges of an appropriate thickness and the web of an appropriate length, the portion having the rib formed on the central portion of the H-shaped web, or the square rod-like portion, can be freely formed in the longitudinal direction. Accordingly, the bending strength of the component can be adjusted over a wide range. Moreover, the portion formed of only the web can be preliminarily formed on an area where no flanges should be formed at the time of extrusion molding. Accordingly, there is no need for the time and labor which would be for cutting off unnecessary flange portions at a later processing stage. Thus, manufacturing cost can be reduced.

At this time, the hole portion 22 is formed in the first die 10 in such a manner as to be in parallel relation with the web shaping-hole 16, and the second die 11 is intimately slidably inserted between the guide surfaces 23 of the hole portion 22. Accordingly, the second die can stably and slidably be held with respect to the first die. Thus, molding accuracy in the component can be enhanced.

In addition, the molding material is formed when it passes through the extrusion shaping-holes which are formed by the bearing portions 14B and 30B of the first and second dies 10 and 11. Accordingly, the slide length of the molding material with respect to the inner wall surface of the extrusion shaping-hole is equal to the wall thickness equivalent portions of the bearing portions 14B and 30B. Because of this feature, friction resistance which may occur at the time of molding can be greatly reduced compared with a case in which the contours of the extrusion holes are formed by the overall width of the wall thickness of the first and second dies 10 and 11. Thus, the friction resistance which may occur at the time of molding can be greatly reduced. As a consequence, the extrusion cylinder required for the above-described extrusion molding can be made smaller. Thus, since the overall apparatus can be made small, and the die set of the present invention is economical.

Moreover, since the bearing portions 14B and 30B of the first and second first dies 10 and 11 are adjacent to each other, in particular, smooth flow of the molding material and minimal distortion can be achieved. Accordingly, the extrusion process can be performed with a high degree of precision.

Figure 16:
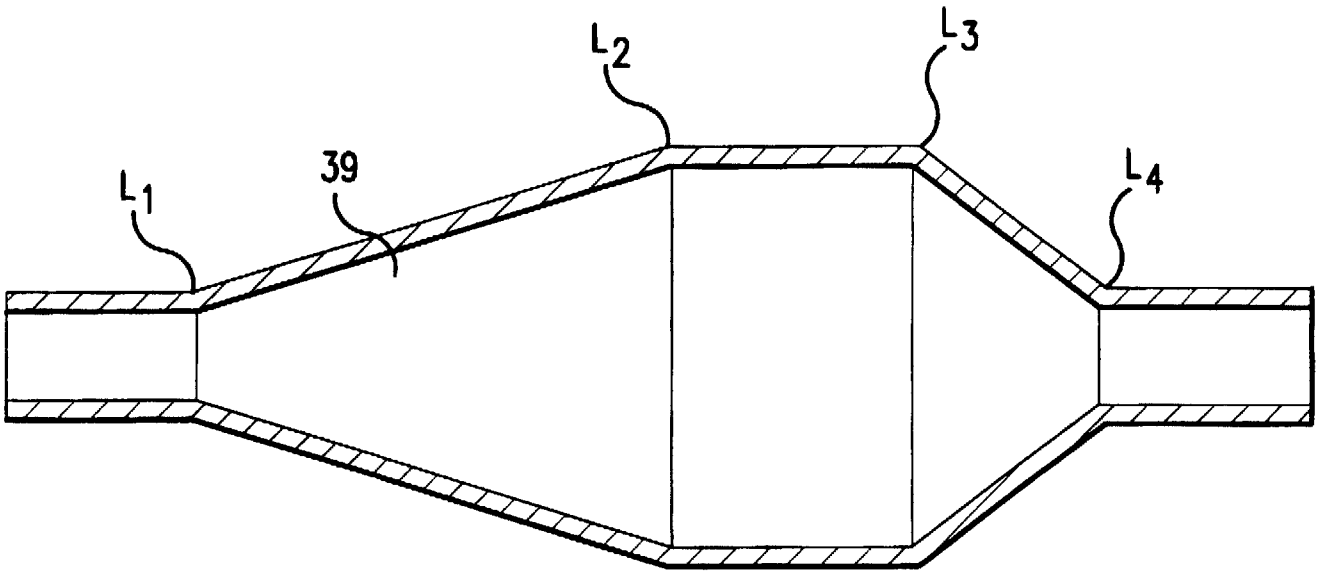
FIG. 16 is a side view showing one example of a structural member shaped by the extrusion molding apparatus of FIG. 6.

In addition, in the case when a variable section component is to be extrusion molded using such an extrusion molding apparatus, as shown in FIG. 16, the areas of the extrusion molding holes as the overlapped portion of the first and second extrusion holes 14 and 30 must be varied by gradually moving the second die 11 by controllably driving the geared motor 41 and the screw jack 42 in accordance with the rate of increase or the rate of decrease of the length of the web, or the like from predetermined length positions $L_1$, $L_2$, $L_3$ and $L_4$ of the molding 39 to be extruded.

However, actually, the molding 39 is continuously extruded, and in addition, the velocity of extrusion is gradually changed depending on the changes of the area of the extrusion shaping-hole. Accordingly, it is difficult to control the opening area of the extrusion shaping-hole by directly measuring the length at real time. For this reason, it is extremely difficult to obtain a molding 39 having a predetermined variable section dimension.

For performing the above-mentioned extrusion molding, therefore, one embodiment of a variable section extrusion molding method according to the present invention, in which the control system shown in FIG. 6 is used, may preferably be employed.

Figure 17:
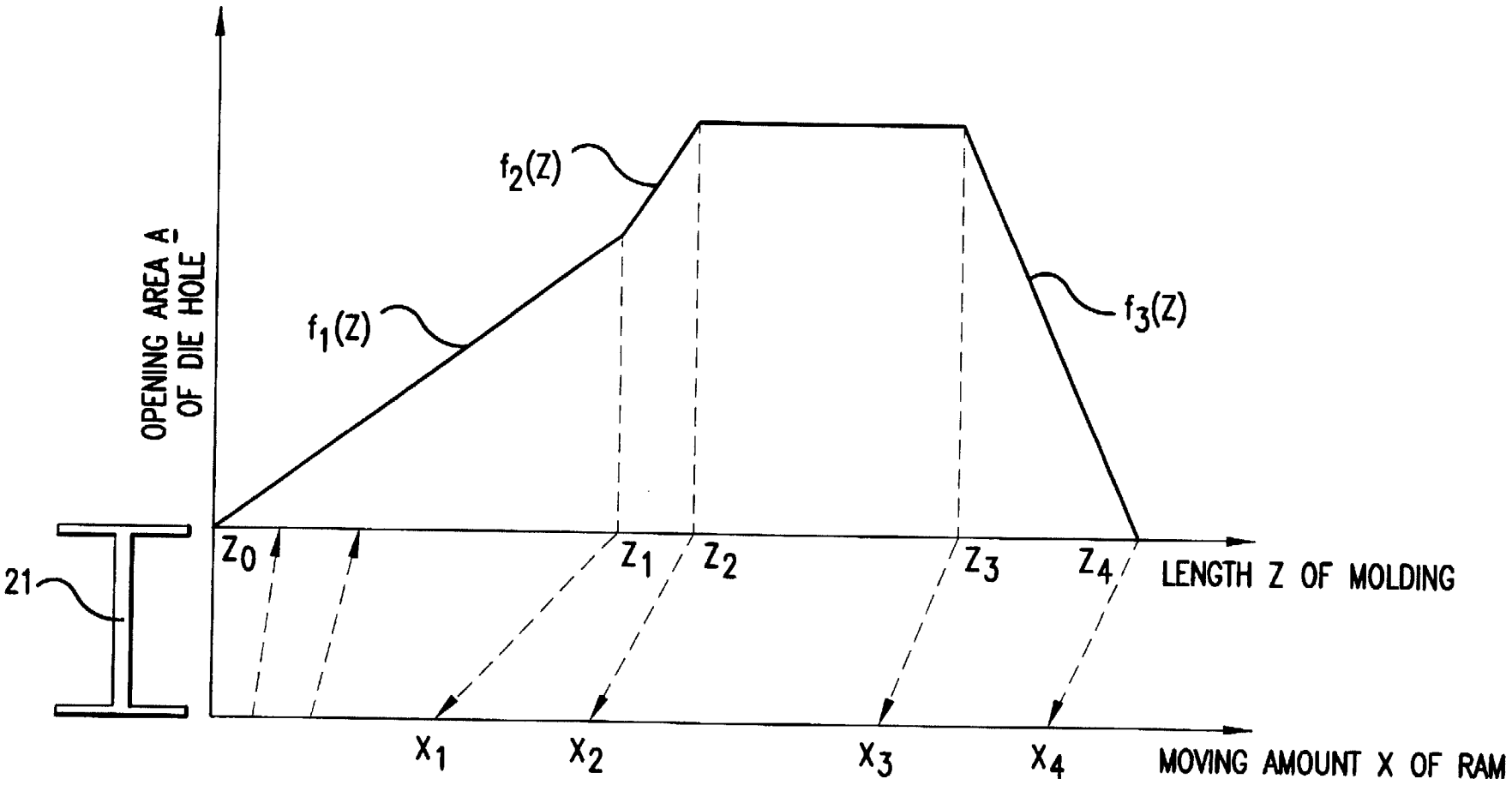
FIG. 17 is a graph showing a relation between the length and the area of a molding shaped by a control system of the extrusion molding apparatus of FIG. 6.

First, FIG. 17 illustrates a variation or change of the sectional area, i.e., opening area of the extrusion shaping-hole, in the longitudinal direction of an H-shaped molding (structural member) which is to be molded using the control system. It should be noted that in this molding 39, the rate of change of the sectional area is linear and therefore, FIG. 17 shows a form which is similar to a case in which the amount of movement of the second die 11 is plotted along the ordinate of FIG. 17. This molding 39 has such a configuration that the length of the web is gradually increased at a constant rate $A=f_1(Z)$ from $Z_0$ to $Z_1$ in the longitudinal direction as indicated by the abscissa of FIG. 17, further increased at an even larger rate $A=f_2(Z)$ from $Z_1$ to $Z_2$, held constant from $Z_2$ to $Z_3$, and then reduced at a constant rate $A=f_3(Z)$ from $Z_3$ to $Z_4$.

Figure 18:
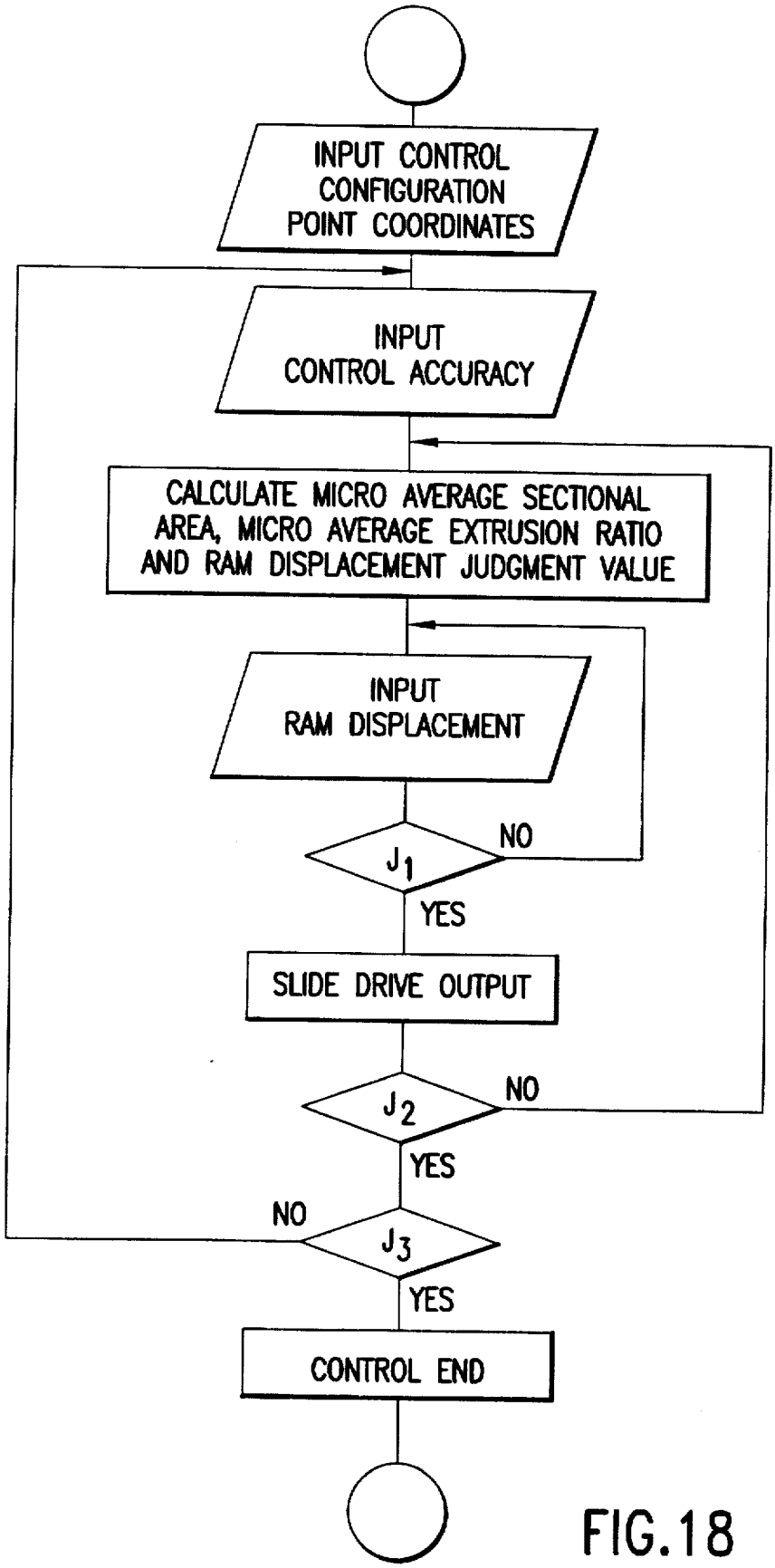
FIG. 18 is a flow chart showing one example of a variable section extrusion die set according to the present invention.

In order to obtain the molding 39 having a form as described above, as shown in FIGS. 6 and 18, data of control configurations such as inclinations and cut-out pieces of $A=f_1(Z)$, $A=f_2(Z)$ and $A=f_3(Z)$, coordinates of $Z_0$ to $Z_4$, the relationships between the amount of movement of the second die 11 and the amount of variation of the opening area A, as well as data of the sectional area D of the container, etc., are preliminarily input from the terminal console 44 to the control unit 45, and then data of control accuracy are input. Based on these data, values of judgment with respect to an average sectional area in a micro distance, an average extrusion ratio (D/A) in a micro distance, and displacement of the ram 37 are calculated at the control unit 45. After the start of a molding operation, data on the amount of movement of the ram 37 from the pulse oscillator 40 are gradually input to the control unit 45. When this input value coincides with the calculated value at $J_1$ of FIG. 18, the geared motor 41 is driven and the second die 11 is caused to move a corresponding distance calculated based on $A=f_1(Z)$ by the screw jack 42. At that time, the amount of movement is feed-back controlled by a detection signal coming from the pulse oscillator 43. Then, the micro movement control procedures hereinbefore described are repeatedly executed. When the ram 37 reaches a point of inflection $X_1$ corresponding to $Z_1$ at $J_2$, the configuration control operation is started with respect to the curved line portion of $A=f_2(Z)$ until the ram 37 reaches $X_2$ corresponding to $Z_2$ again.

In this way, when the configuration control operation is completed with respect to th e curved line portion of $A=f_3(Z)$, a judgment is made at $J_3$ indicating that the configuration control operation has been completed. Thus, a sequence of control operation is completed.

In this way, according to the control method using the above-described control system, first, data on the rates of variation $A=f_1(z)$, $A=f_2(Z)$ and $A=f_3(Z)$ of the open ing area of the extrusion shaping-hole versus the length of the molding 39, the sectional area of the container, etc., are input to the control unit 45. Then, the amount of movement of the second die 11 is controlled such that the extrusion length Z of the molding 39 and the opening area A will become the extrusion volume of the molding 39 obtained from the amount of movement of the ram, while detecting the amount of movement coming from the pulse oscillator 40 when the extrusion molding operation is performed. Accordingly, the configuration relative to the length Z of the molding 39 can be easily controlled along with the extrusion operation of the molding material 39 and without directly measuring the extrusion length of the molding. Thus, a structural member of a variable cross section can be extrusion molded with a high degree of precision.

For performing the above-described control operation, the pulse oscillators 40 and 43 and the control unit 45 (such as a small personal computer), which are all commercially available, can be used. For this r e ason, the above-described control operation can be perf ormed without any substantial changes applied to the conventional extrusion molding apparatus and with only a minor change of equipment being added thereto.

Second Embodiment

FIGS. 19 through 22 show a second embodiment in which the extrusion die set of the present invention is applied to an apparatus for extruding a generally U-shaped member having a flangeless portion. Since the construction of parts other than the first and second extrusion holes is the same as in the first embodiment, description thereof is omitted.

Figure 19:
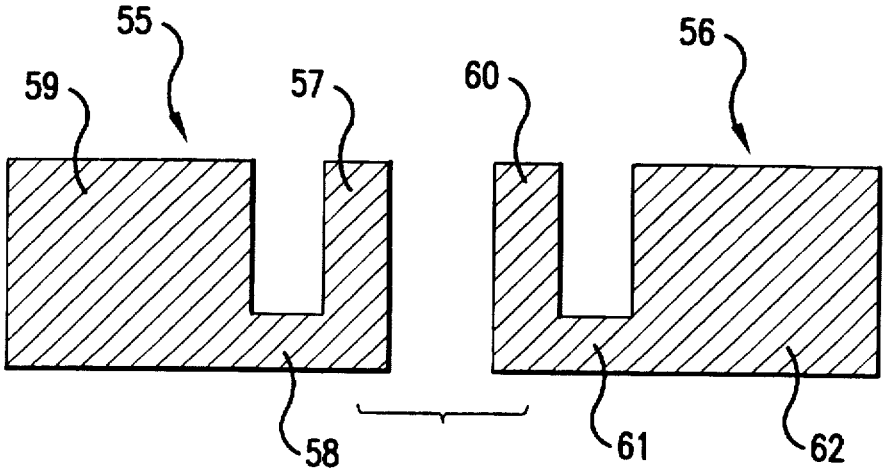
FIG. 19 is a plan view showing the shapes of a first and a second extrusion hole in a second embodiment of a variable section extrusion die set according to the present invention.

As shown in FIG. 19, in this extrusion die set, a first extrusion hole 55 is formed in the first die and a second extrusion hole 56 is formed in the second die.

The first extrusion hole 55 includes a flange portion shaping-hole 57 having a width equal to a maximum thickness of one of flanges in a component to be molded, a web shaping-hole 58 extending in a direction perpendicular to one end portion of the flange portion shaping-hole 57, and a flange portion communication hole 59 formed in the other end portion of the web shaping-hole 58. The flange portion communication hole 59 has the same length as the flange portion shaping-hole 57 and a larger width than that of the flange portion shaping-hole 57.

On the other hand, the second extrusion hole 56 includes a flange portion shaping-hole 60 having a dimension equal to that of the first extrusion hole 55, a web shaping-hole 61 extending in a direction perpendicular to the flange portion shaping-hole 55, and a flange portion communication hole 62 formed in the other end portion of the web shaping-hole 61.

The second die is slidably inserted along the guide walls within the hole portion of the first die such that the flange portion shaping-hole 60 is situated on the side of the flange portion communication hole 59 of the first extrusion hole 55, and the web communication holes 58 and 59 are communicated with each other. In this way, the first extrusion hole 55 and the second extrusion hole 56 are arranged in order in the extrusion direction of the molding material.

Figure 20:
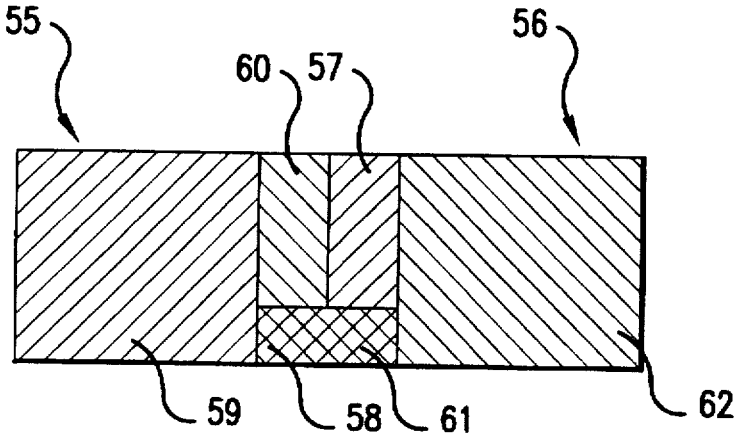
FIG. 20 is a plan view showing a state where only a web is shaped by the first and second extrusion holes of FIG. 19.

For shaping the component by the extrusion die set thus constructed, first, as shown in FIG. 20, the second die is moved so that the web shaping-holes 58 and 61 of the first extrusion hole 55 and the second extrusion hole 56 are brought into engagement with each other, and one flange portion shaping-holes 57 and 60 are not brought into communication with the other flange portion communication holes 59 and 62. When the molding material is extruded in that position, a component having only the web can be molded. At this time, by moving the second die along the web shaping-holes 58 and 61 while maintaining the above-described state, the length of the web in the component can be varied in the longitudinal direction.

Figure 21:
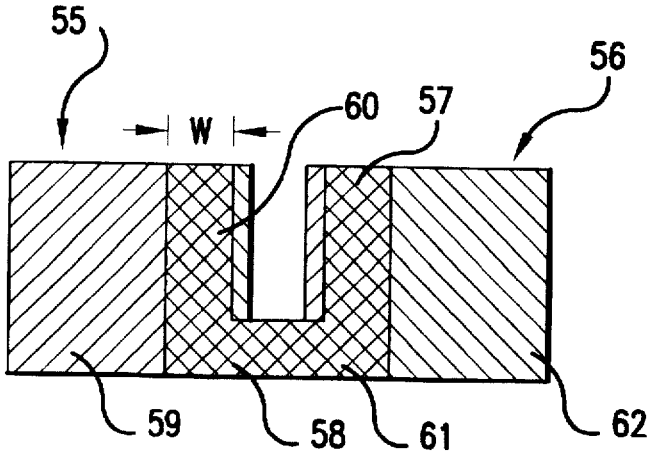
FIG. 21 is a plan view showing a state in which the web and a pair of flanges are formed by the first and second extrusion holes of FIG. 19.

Next, as shown in FIG. 21, the second die is further moved so that parts of shaping-holes 57 and 60 of one flange portion are brought into communication with communication holes 59 and 62 of the other flange portion, respectively. When the molding material is extruded in that position, a component of a generally U-shaped configuration in cross section having flanges of a thickness W corresponding to the communicating portions of the flange portion shaping-holes 57 and 60 is molded. At this time, by moving the second die while maintaining the above-described state, the thickness W in the component can be appropriately changed in the longitudinal direction.

Figure 22:
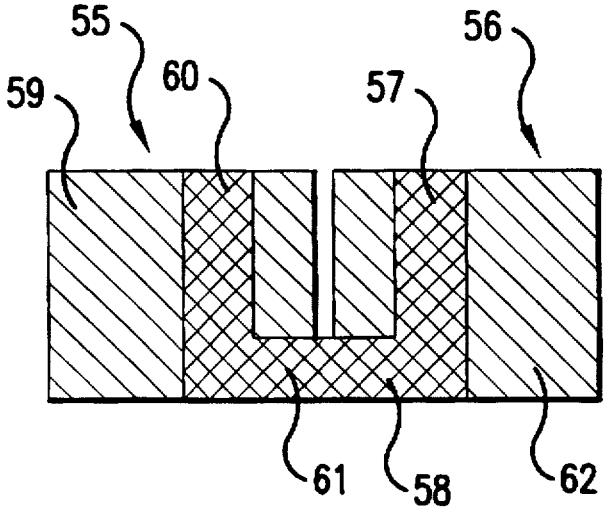
FIG. 22 is a plan view showing a state in which the flanges of FIG. 21, the flanges have the maximum width, are molded.

As shown in FIG. 22, the second die is further moved so that an entirety of the shaping-holes 57 and 60 of one flange portion and the shaping-holes 58 and 62 of the other flange portion are also brought into communication with each other. When the molding material is extruded in that position, a component of a generally U-shaped configuration in cross section, having flanges of a maximum thickness at opposite end portions of the web, is molded. Here, the second die is further moved along the web shaping-holes 58 and 61 while maintaining the above-described state, thereby enabling the variation of the length of the web between the flanges.

Accordingly, also with the extrusion die set of this embodiment, the same operation and effect as the extrusion die set in the first embodiment can be obtained.

In either the first or the second embodiments, the first die 10 is firmly secured to the container and the second die 11 is slidably inserted into the interior of the hole portion 22 of the first die 10. However, the present invention is not limited to this. The present invention may be arranged such that the second die is firmly secured and the first die is movably disposed. The present invention may also be arranged such that both the first and second dies are movably disposed.

Third Embodiment

FIGS. 23 through 26 show a third embodiment in which a variable section extrusion die set of the present invention is applied to an apparatus for extruding an H-shaped member having a flangeless portion.

An extrusion die set 70 comprises a first die 71, a second die 72, and third dies 73A and 73B, which are formed by a hot tool steel. The first and second dies 71 and 72 are combined with each other such that they can move relatively in the X- direction perpendicular to the extrusion direction of the molding material, while the third dies 73A and 73B are combined respectively with the first and second dies 71 and 72 so that they can move in a direction perpendicular to the extrusion direction of the molding material and perpendicular to the X-direction. Here, the first die 71 is a stationary die which is to be firmly secured to the container side, while the second die 72 is a movable die which can move relative to the first die 71.

The first and second dies 71 and 72 are provided respectively with a first extrusion hole 81 and a second extrusion hole 82 serving as openings for forming the extrusion shaping-holes. In this embodiment, for the purpose of convenience for molding an H-shaped material, the first extrusion hole 81 and the second extrusion hole 82 have the same shape. The first and second extrusion shaping-holes 81 and 82 comprise flange portion shaping-holes **81*a* and 82*a* having the widths equal to the maximum thicknesses of the flanges in a component such as a side-frame to be molded, web shaping-holes 81*b* and 82*b*extending in a direction perpendicular to the central portions of the flange portion shaping-holes 81*a* and 82*a*, and flange portion communication holes 81*c* and 82*c* formed on the other end portions of the web shaping-holes 81*b* and 82*b*. Here, the flange portion communication holes 81*c* and 82*c* have the same length as the flange portion shaping-holes 81*a* and 82*a*, and have a larger width than the flange portion shaping-holes 81*a*and 82*a***.

Figure 23A:
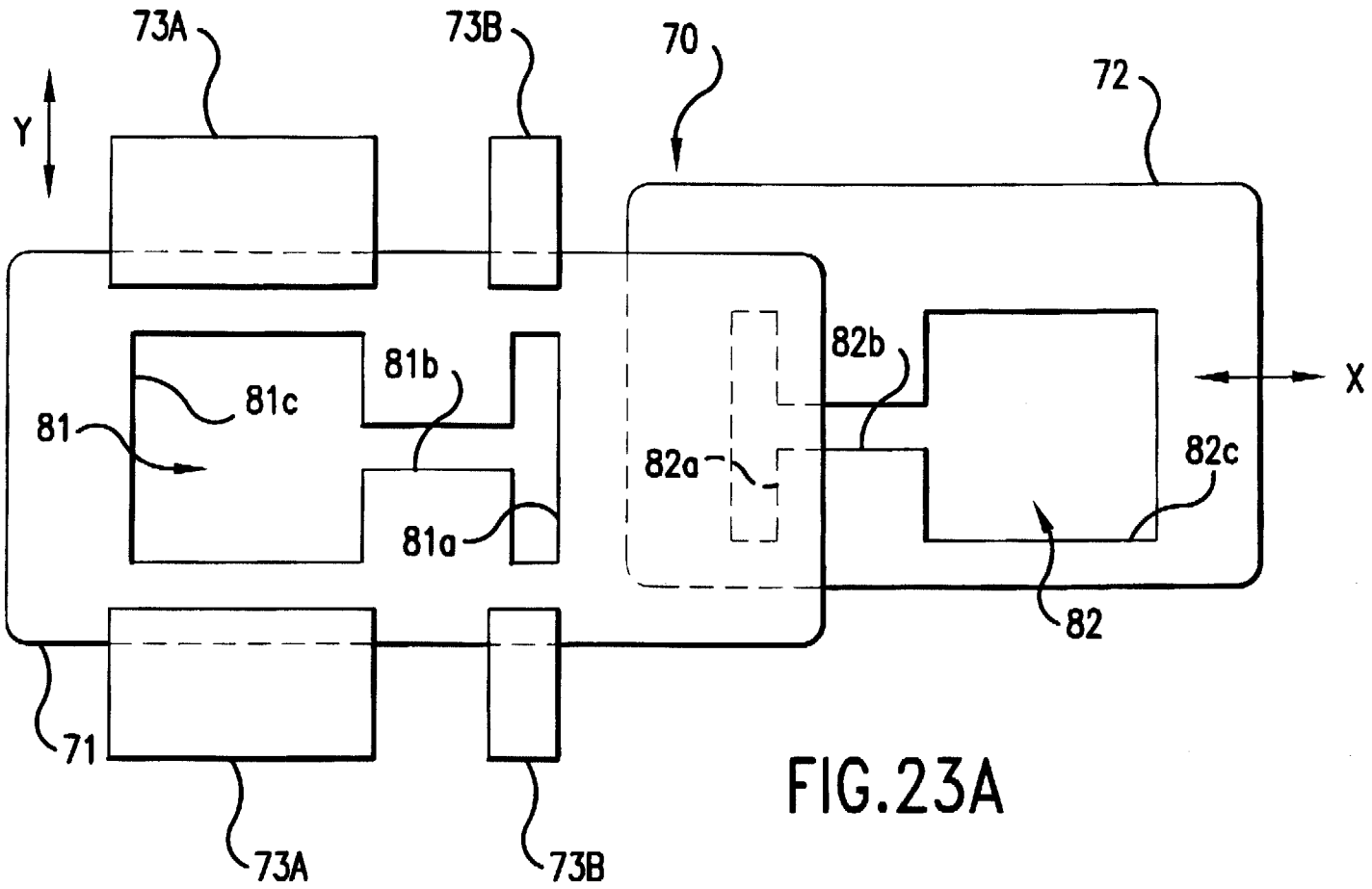
FIG. 23 is a conceptual view of a third embodiment of a variable section extrusion die set according to the present invention.
Figure 23B:
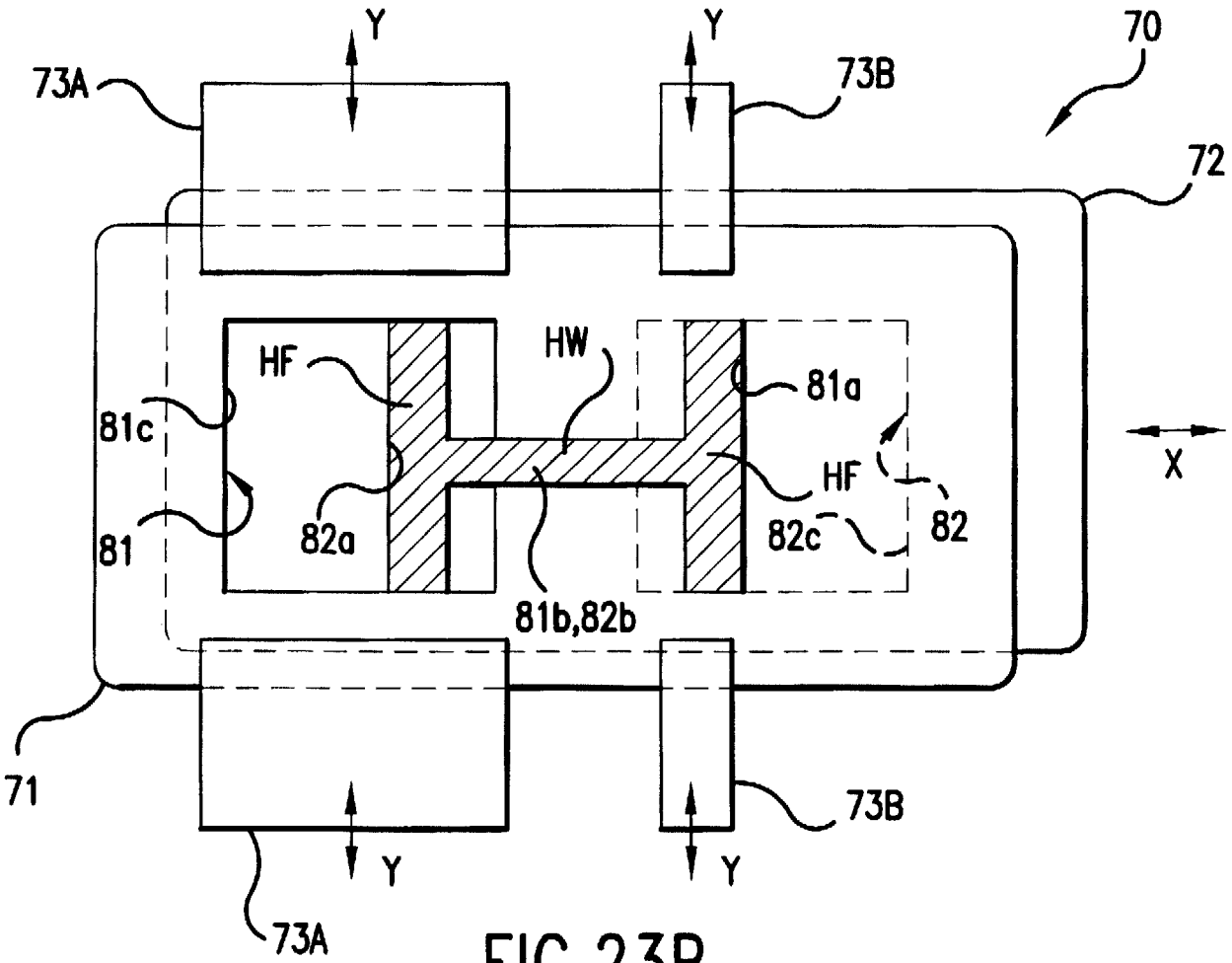

The second die 72 is combined with the first die 71 such that its flange portion shaping-hole **82*a* is situated on the side of the flange portion communication hole 81*c* of the first extrusion hole 81; in other words, the second die 72 is disposed symmetrical with a line parallel to the extensions of the flange portion shaping-holes 81*a* and 82*a*, and the web shaping-holes 81*b* and 82*b* are communicated with each other. The first and second extrusion holes 81 and 82 are arranged in order in the extruding direction of the molding material. Accordingly, as indicated by hatching in FIG. 23(*b*), a substantial extrusion hole is formed at that area where the first extrusion hole 81 and the second extrusion hole 82 are overlapped with each other. In FIG. 23(*b*), an H-shaped extrusion hole (a web shaping-portion and a flange shaping portion of the extrusion molding hole are denoted by reference characters HW and HF, respectively) for forming an H-shaped member consisting of a web HW and flanges HF formed on opposite ends thereof, is formed. In this case, the relative movement direction (Y-direction) of the first and second dies 71 and 72 is set to be parallel to the web shaping-holes 81*b* and 82*b***.

Figure 24:
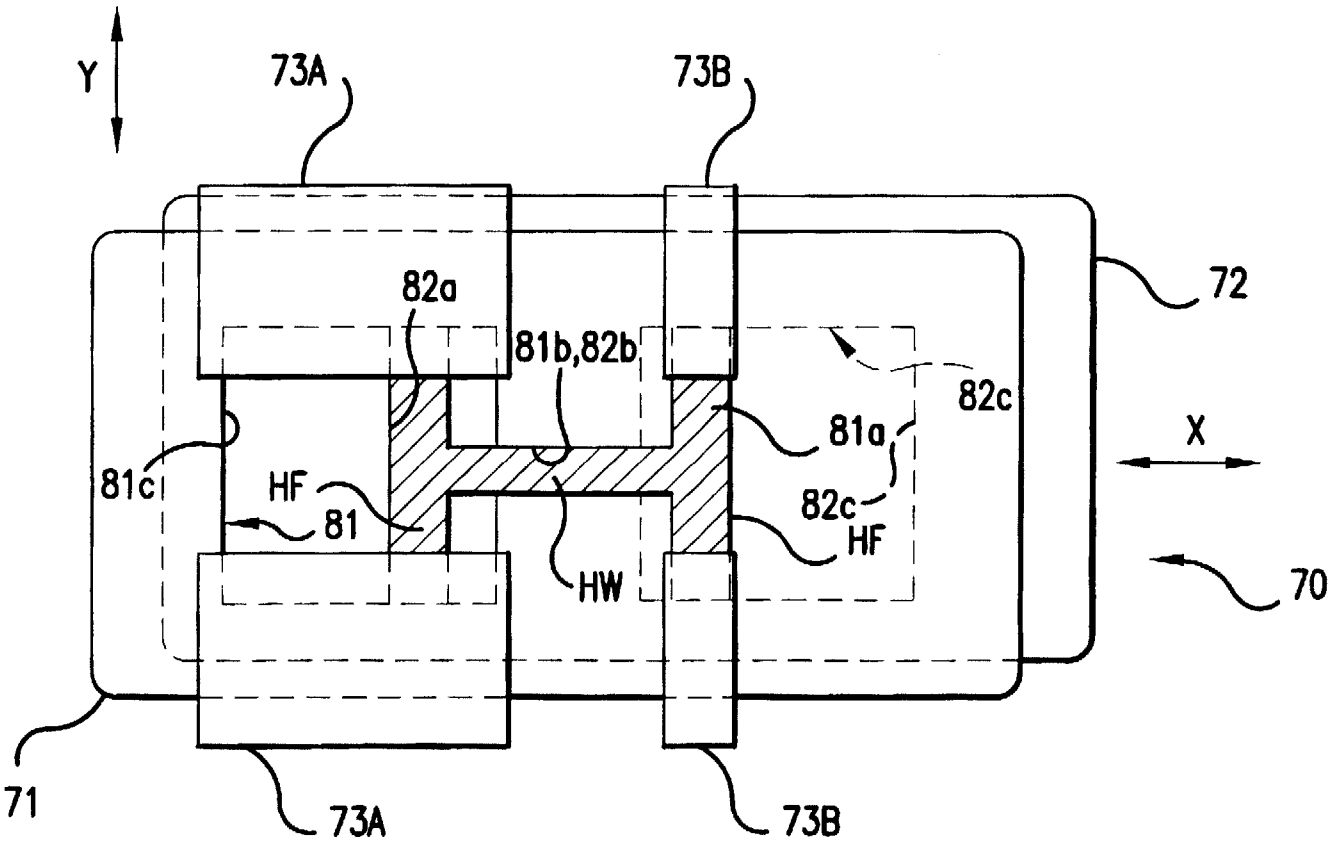
FIG. 24 is a conceptual view showing a state in which a third die is operated in the third embodiment.

The third dies 73A and 73B are arranged outwardly of opposite end portions in the Y-direction of the flange portion shaping-hole 81*a* and the flange portion communication hole 81*c*of the fixed side die, namely, the first die 71. The third dies 73A and 73B can move in the Y-direction. By moving the third dies 73A and 73B towards the center line of the first extrusion hole 81 in the Y-direction, the dimensions of the flange portion shaping-hole 81*a* and the flange portion communication hole 81*c* can be reduced in the Y-direction. As shown in FIG. 23(*b*), opposite end faces in the Y-direction of the flange portion shaping-hole 81*a* and the flange portion communication hole 81*c* regulate the maximum width in the Y-direction of the extrusion shaping-hole, namely, the length of the flange HF in case in which the H-shaped member is to be formed. By substantially changing the positions of the opposite end faces by the third dies 73A and 73B, the lengths of the flanges HF can be adjusted as shown in FIG. 24.

Figure 25:
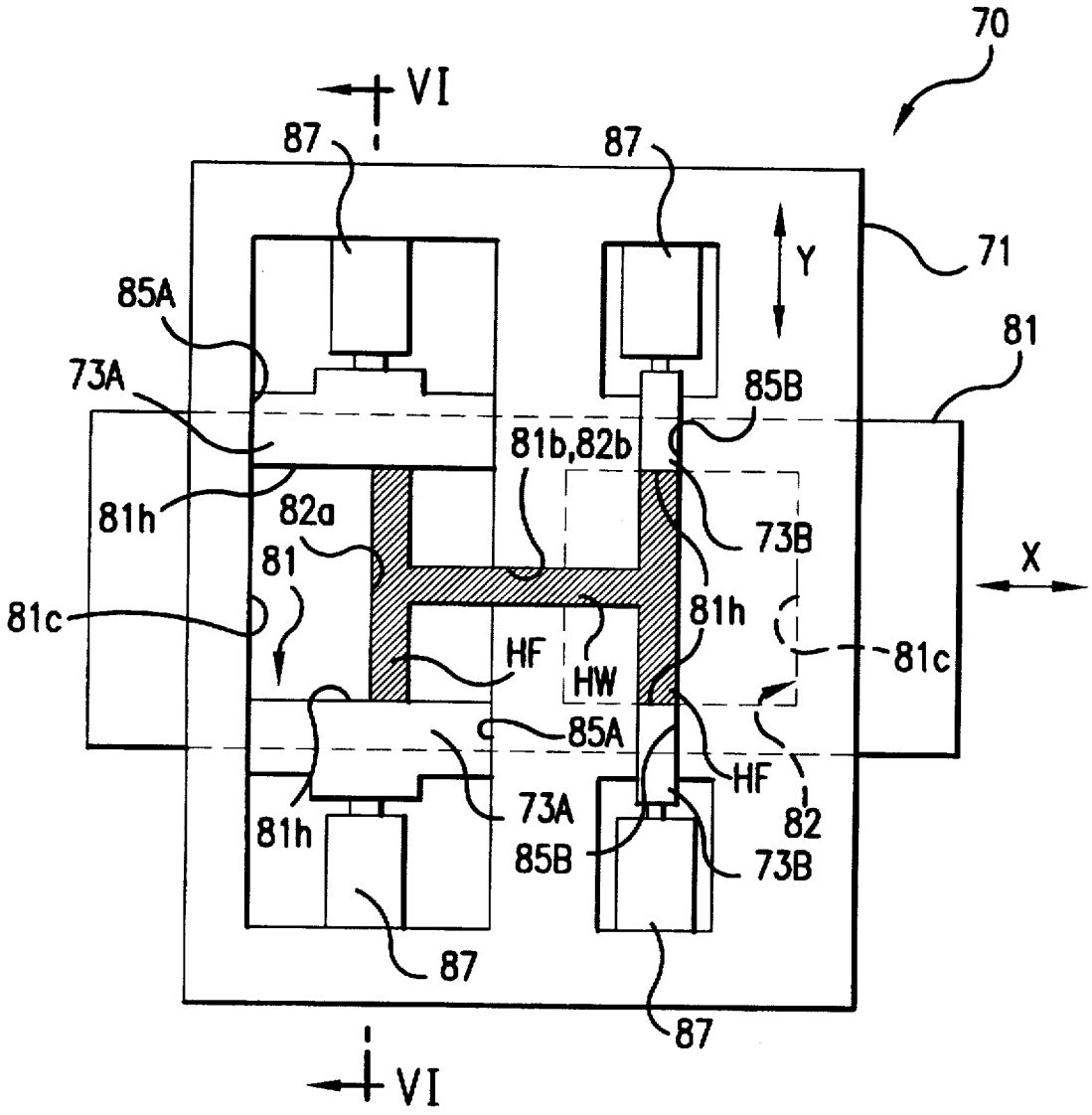
FIG. 25 is a plan view showing a specific construction of the third embodiment.
Figure 26:
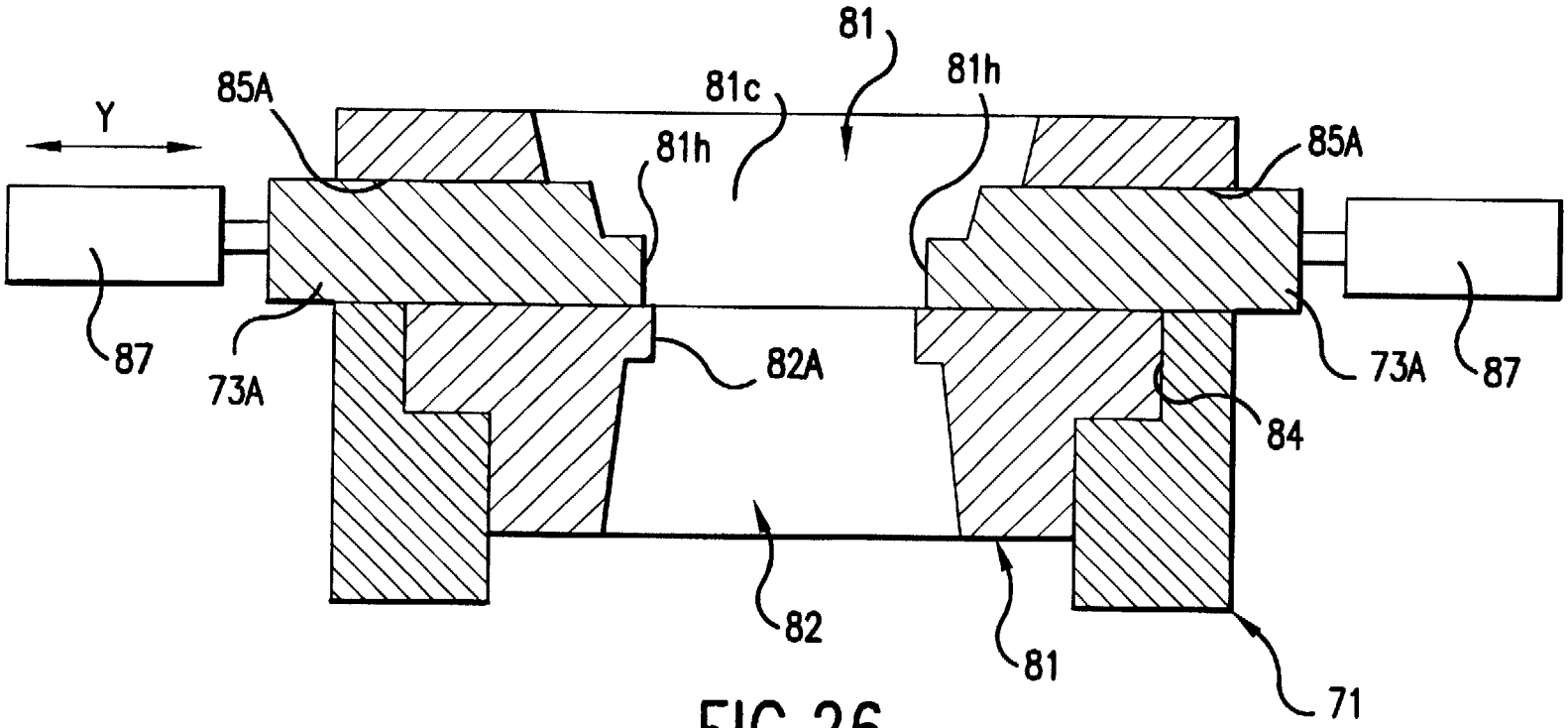
FIG. 26 is a sectional view showing, in a simplified manner, a portion taken along the line VI—VI in FIG. 25 and viewed in a direction as indicated by arrows.

FIGS. 25 and 26 are views more specifically showing a construction of the extrusion die 70.

In the extrusion die 70 illustrated in these Figures, the third dies 73A and 73B are not overlapped on the first die 71 as shown in FIG. 23, but the third dies 73A and 73B are instead incorporated in the first die 71 in order to form the wall surfaces of the first extrusion hole 81 of the first die 71 as shown in FIG. 25. That is, in the extrusion die 70, the wall surface for defining opposite ends in the Y-direction of the flange portion communication hole 81*c* and the flange portion shaping hole 81*c* of the first die 71 is a movable wall 81*h*. This movable wall 81*h* is constituted of the third dies 73A and 73B. More specifically, the third dies 73A and 73B are fitted, respectively, into groove portions 85A and 85B formed in the Y-direction in the first die 71 such that they are slidable in the Y-direction along the groove portions 85A and 85B each having a width equal to those of the flange portion communication hole 81 and the flange portion shaping-hole 81*a* in the Y-direction. The opposite end portions in the Y-direction of the flange portion communication hole 81*c* and the flange portion shaping-hole 81*a* are constituted by the groove portions 85A and 85B.

On the other hand, the second die 72 is slidably inserted in a hole portion 84 formed in the first die 71 and extending in the X-direction. As a moving mechanism of the second die 72, there may be provided, for example, a cylinder, and as a moving mechanism of the third dies 73A and 73B, cylinders 87 are separately provided.

A method for extruding a component such as a side-frame or the like, which is made of aluminum or aluminum alloy, with the use of the extrusion die 70 thus constructed, will now be described with reference to FIGS. 27 and 28.

Figure 27A:
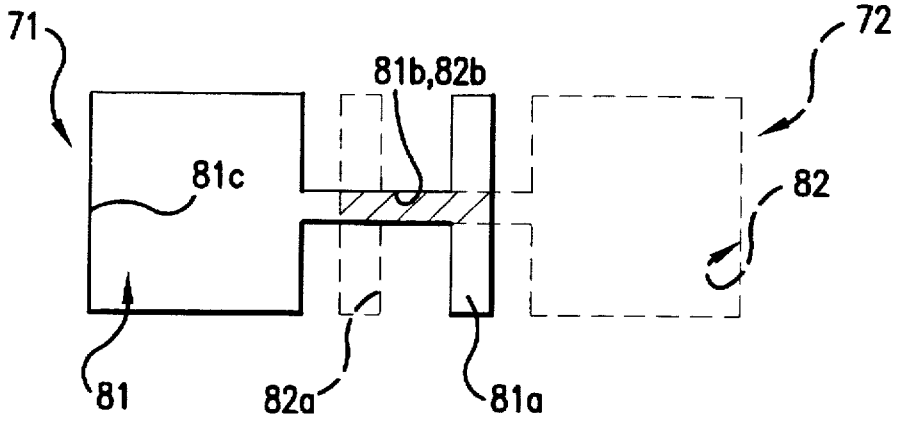
FIGS. 27 (*a–c*) shows views of examples of sections of structural members which can be formed by relative movement of the first and second dies in the third embodiment.
Figure 27B:
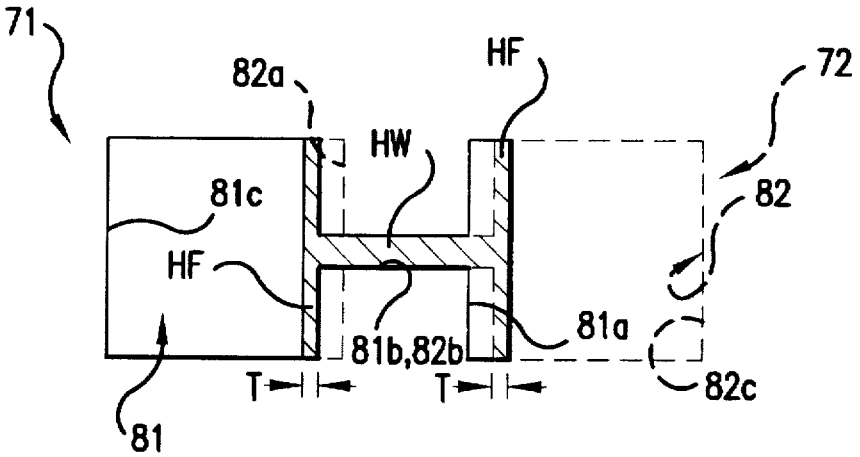
Figure 27C:
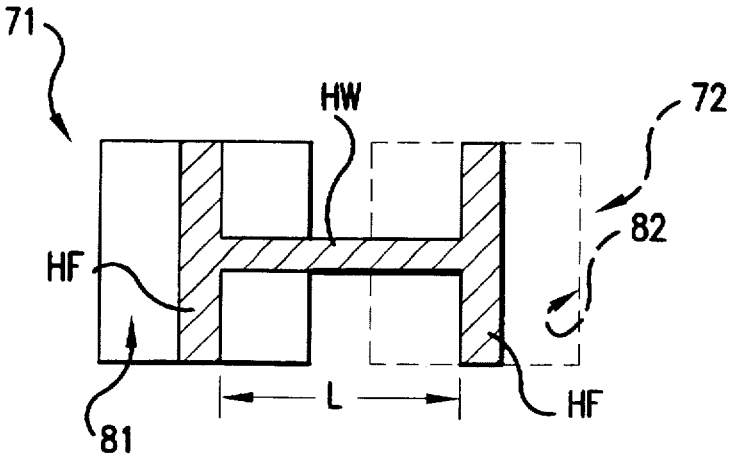
Figure 28A:
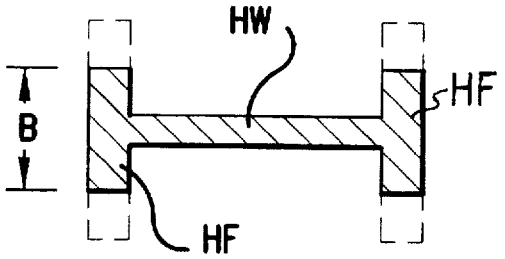
FIG. 28 (*a–f*) shows views of examples of sections of structural members which can be formed by adjusting the position of the third die in the third embodiment.
Figure 28B:
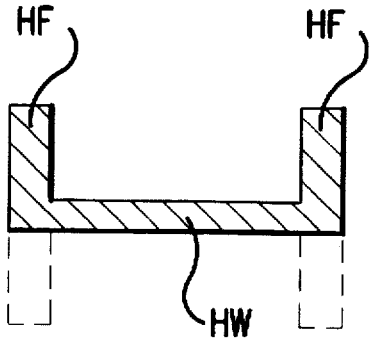
Figure 28C:
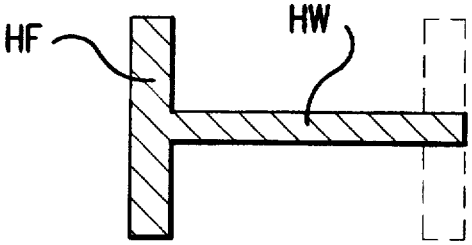
Figure 28D:
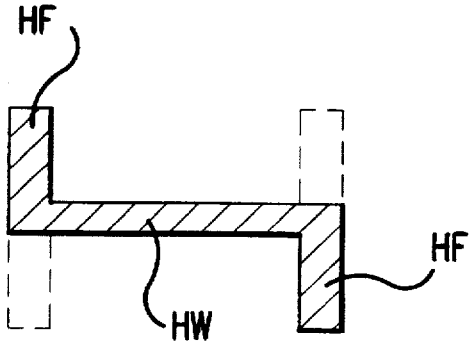
Figure 28E:
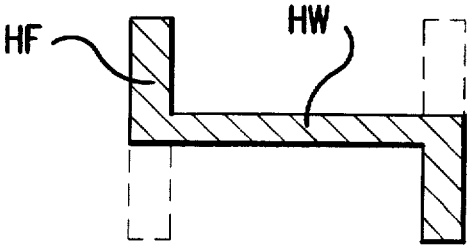
Figure 28F:
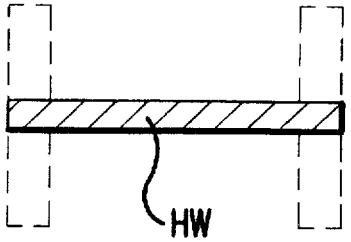
Figure 29A:
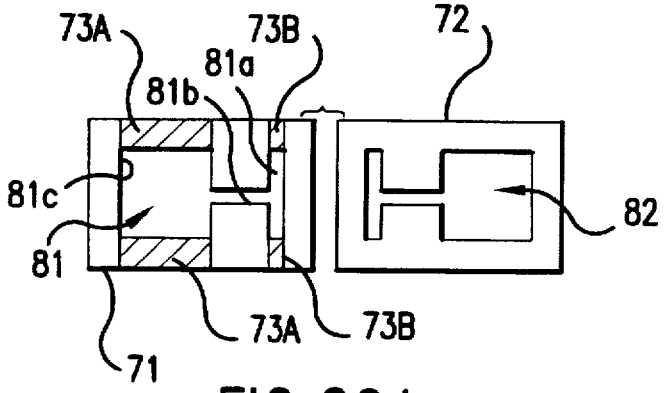
FIG. 29 (*a–d*) show schematic views of examples of installation positions of the third die in the variable section extrusion die set according to the present invention.
Figure 29B:
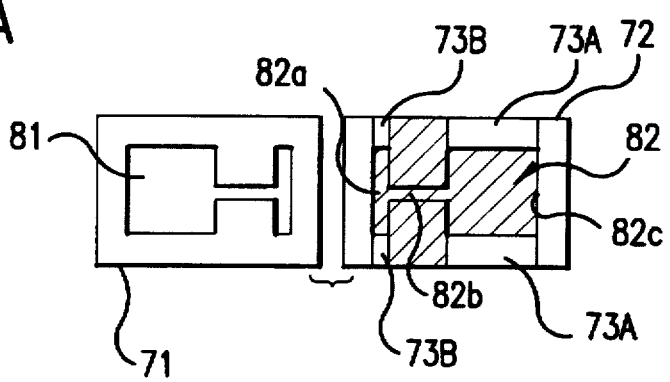
Figure 29C:
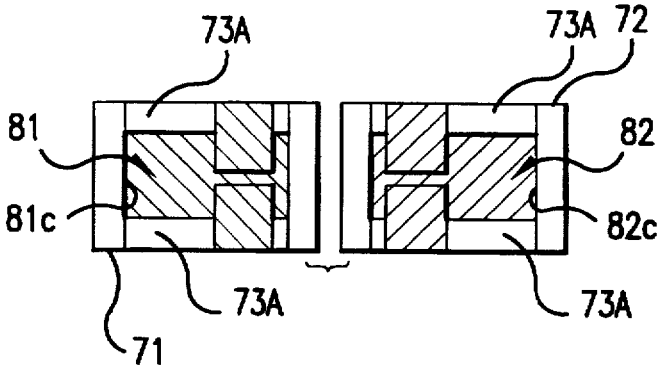
Figure 29D:
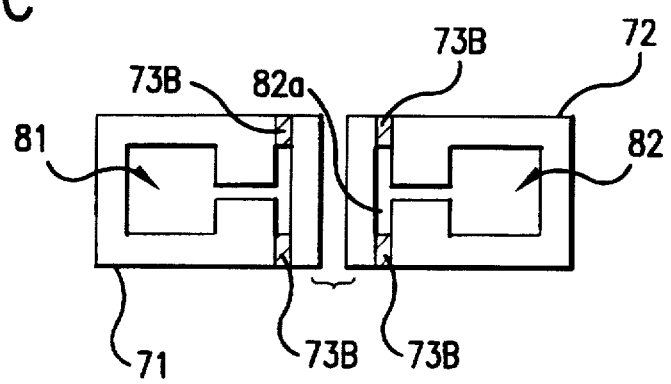

In FIG. 27, a portion indicated by a solid line shows the configuration of the first extrusion hole 81, whereas a portion indicated by a dotted line shows the configuration of the second extrusion hole 82. Similarly, a portion indicated by hatching shows a sectional configuration of an extrusion shaping-hole, i.e., a structural member to be molded; the extrusion shaping-hole is formed by the overlapping portion of the first extrusion hole 81 and the second extrusion hole 82. First, as shown in FIG. 28(*a*), the second die 72 is slid with respect to the first die 71 by a drive mechanism (not shown) so that the web shaping-holes 81*b* and 82*b* of the first extrusion hole 81 and the second extrusion hole 81 are brought into communication with each other, and the flange portion shaping-holes 81*a* and 82*a* are held in non-communicated position with respect to the other flange communication holes 81*c*and 82*c*. In this position, the aluminum or aluminum alloy as the molding material is extruded. Since the molding material is extruded passing only through the communicating portion of the web shaping holes 81*b* and 82*b*, a planar component having only a flat bar-like web corresponding in length of the communication portion is formed. At this time, by changing the communicating portions of the web shaping-holes 81*b* and 82*b* by moving the second die 72 while maintaining the above-described state, the length of the web in the component can be varied in the longitudinal direction.

Next, as shown in FIG. 27(*b*), the second die 72 is further moved towards the first die 71 so that parts of the flange portion shaping-holes 81*a* and 82*a* are communicated with the other flange portion communication holes 81*c* and 82*c*. In this position, the molding material is extruded. As a result, an H-shaped component having flanges HF, each having a thickness T equal to the communicating portion between the flange portion shaping-holes 81*a* and 82*b*, is formed. Then, by moving the second die 72 while maintaining the above-described state, the thickness W of the flanges HF in the component can be appropriately changed in the longitudinal direction.

Furthermore, as shown in FIG. 27(*c*), by moving the second die 72, the flange portion shaping- holes 81*a* and 82*a* of the first extrusion hole 81 and the second extrusion hole 82 are brought to be fully communicated with the other flange portion communication holes 81*c* and 82*c*. In this position, when the molding material is extruded, an H-shaped component having flanges HF of a maximum thickness is formed on the opposite end portions of the web HW. Then, by moving the second die 72 while maintaining the above-described state, the length L of the web HW between the flanges HF and HF can be gradually changed.

When the third dies 73A and 73B are appropriately moved at the time of molding shown in FIGS. 27(*b*) and 27(*c*), the length dimension B of the flanges HF can be appropriately changed as shown in FIG. 28(*a*), and various cross sectional configurations such as a C-shape, a T-shape, a Z-shape, a L-shape, an I-shape and the like, in which the flanges HF are sufficiently reduced, can be obtained, as is shown in FIGS. 28(*b*) th rough 28(*f*).

Therefore, according to the extrusion die set 70, by appropriately changing the relative positions of the first die 71, the second die 72, and the third dies 73A and 73B, not only can the length of the web HW be adjusted, but also even the thickness and length of the flanges HF can be freely adjusted, thus enabling adjustment of the bending strength of the component over a wide range. Moreover, in the case in which the flange or flanges are omitted or the length of the flanges is shortened in consideration of strength, or in the case in which the flanges are locally adjusted in dimension so that the flanges do not interfere with other members when the component is fitted to a vehicle main frame or the like, the requirement for such local adjustment can be simply met at the time of molding. Accordingly, there is no need for the time and labor for cutting off unnecessary flange portions which would otherwise be necessary at a later processing stage. Thus, the manufacturing cost can be reduced.

Further, the wall surface of the first extrusion hole 81 of the first die 71 is constructed directly by the first dies 73A and 73B. The hole portion 84 extending in the X-direction and the groove portions 85A and 85B extending in the Y-direction are formed on the first die 71, the second die 72 is slidably inserted into the hole portion 84, and the third dies 73A and 73B are slidably inserted into the groove portions 85A and 85B, respectively. Accordingly, the second die 72 and the third dies 73A and 73B can be stably and slidably held with respect to the first die 71. Thus, molding accuracy in the component can be enhanced.

In this embodiment, as is schematically shown in FIG. 29(*a*), the third dies 73A and 73B are provided on either side of the flange portion communication hole 81*c* or on either side of the flange portion shaping hole 81*a* of the first die 71. Alternatively, however, the third dies 73A and 73B may be provided on the side of the second die 72 as shown in FIG. 29(*b*) or may be provided at only one pair of sides of the flange portion communication holes 81*c* and 82*c* as shown in FIG. 29(*c*). Also, the third dies 73A and 73B may be provided at only one pair of sides of the flange portion shaping-holes 81*a* and 82*a* of the first and second dies 71 and 72 as shown in FIG. 29(*d*).

In the above embodiments, a case has been described in which the first die 73A is on the side of the flange portion communication holes 81*c* and 82*c* and the third die 73B is on the side of the flange portion shaping-holes 81*a* and 82*a*. However, if independent adjustment of the third dies is unnecessary, the divided parts may be used in a unified form.

Figure 30:
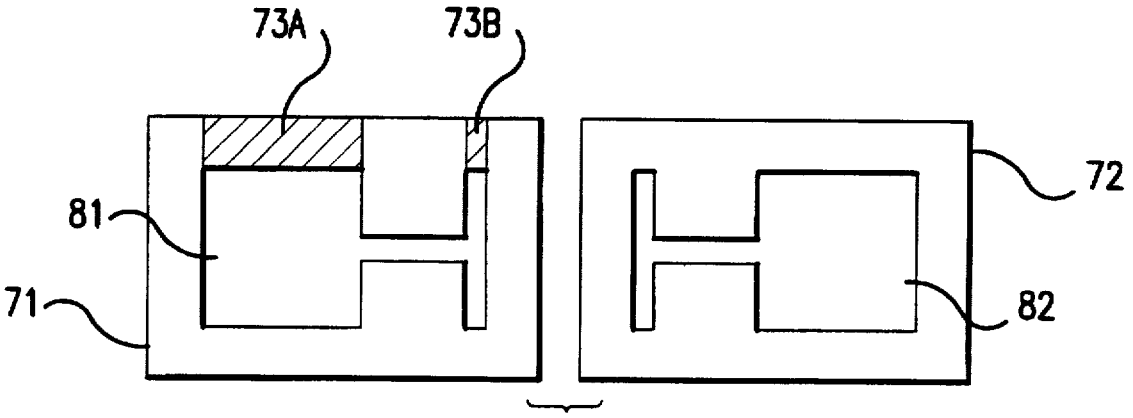
FIG. 30 is a schematic view showing another example of the installation position of the third die.
Figure 31:
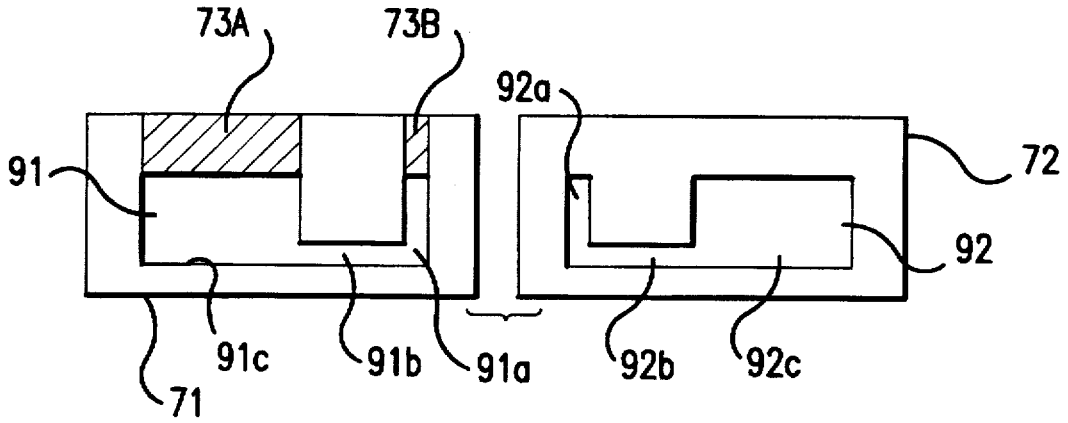
FIG. 31 is a conceptual view showing a modified example of the third embodiment of the variable section extrusion die set according to the present invention.
Figure 32:
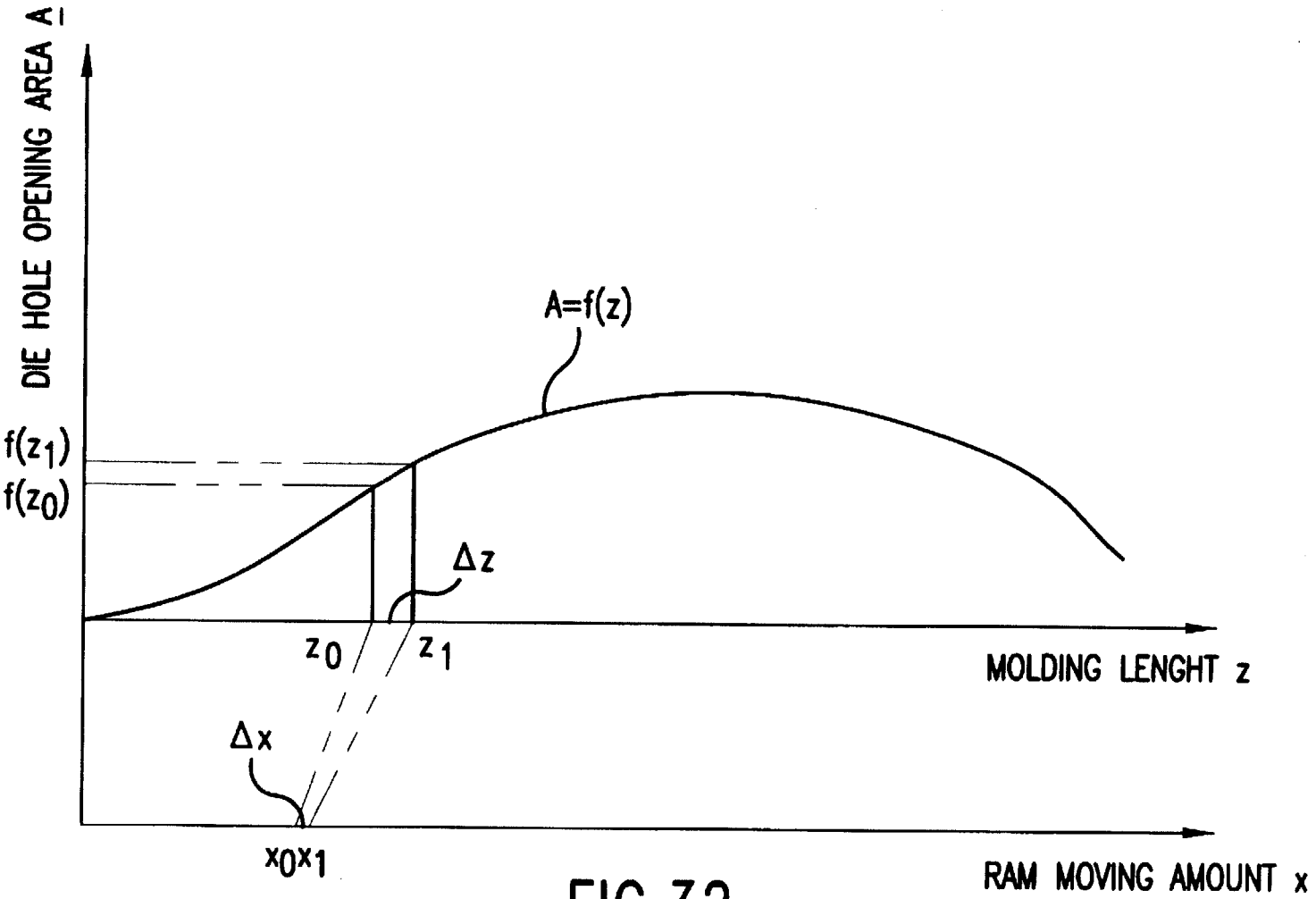
FIG. 32 is a graph for explaining the principles of a variable section extrusion molding method according to the present invention.
Figure 33:
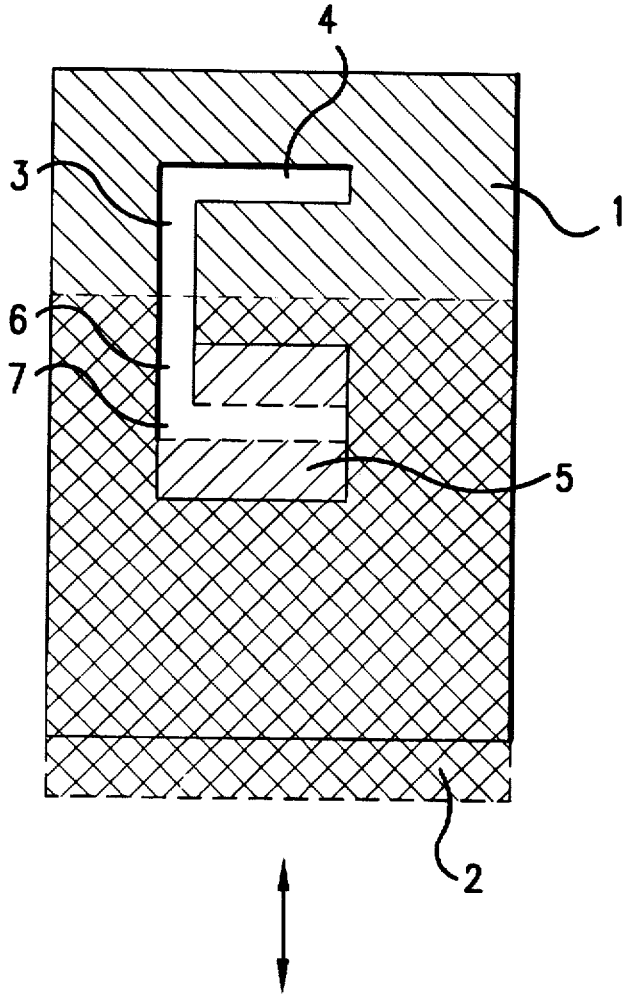
FIG.33 PRIOR ART
FIG. 33 is a vertical sectional view showing a conventional extrusion die set.

Further, in the above embodiments, a number, four in total, of the third dies 73A and 73B are provided in order to adjust the dimension of each end of the two flanges of the H-shaped member. However, if only the dimension of one end of each flange is required to be adjusted, the third dies 73A and 73B may be provided on the single side as shown in FIG. 30. Moreover, if only the dimension of opposite ends of a single flange is required to be adjusted, appropriate dies may be provided only on the side of the first die 71 or only on one pair of sides of the second die 72 of FIGS. 29(*c*) and 29(*d*). If the dimensional adjustment is required only with respect to one end of one flange, the third dies 73A and 73B may be provided at one selected location.

If only a component having a C-shaped section is required to be formed instead of forming the component having the H-shaped section as in the above embodiments, it is sufficient for a first extrusion hole 91 and a second extrusion hole 92 comprising flange portion shaping-holes 91*a* and 92*a* and flange portion communication holes 91*c* and 92*c* (half parts are omitted from the illustration) to be provided around the web shaping-holes 91*b* and 92*b*.

Industrial Applicability

As described hereinbefore, in a variable section extrusion die set and a variable section extrusion molding method according to the present invention, a molding material such as aluminum or the like can be molded by freely varying the length of the web, the presence or absence of the flanges, the thickness thereof, etc., in the longitudinal direction when such molding material is subjected to extrusion molding. Accordingly, the present invention can be suitably applied to a case in which components such as chassis members, vehicle main-frame members, bumpers, etc., for various types of automotive vehicles such as common automobiles, trucks, etc., are to be integrally molded of aluminum or aluminum alloy or the like.

We claim:

1. A variable section extrusion die set comprising a first die and a second die, said first die being formed therein with a first extrusion hole, said first extrusion hole including a flange portion shaping-hole having a width equal to a maximum thickness, a web shaping-hole extending in a direction substantially perpendicular to said flange portion shaping-hole, said web shaping-hole having first and second end portions said first end portion terminating in said flange portion shaping-hole of said first extrusion hole, and a flange portion communication hole formed in said second end portion of said web shaping-hole and having a larger width than said flange portion shaping-hole, said second die being formed therein with a second extrusion hole, said second extrusion hole including a flange portion shaping-hole having a width equal to said maximum thickness, a web shaping-hole extending in a direction substantially perpendicular to said flange portion shaping-hole, said web-shaping hole having third and fourth end portions said third end portion terminating in said flange portion shaping-hole of said second extrusion hole, and a flange portion communication hole formed in said fourth end portion of said web shaping-hole and having a larger width than said flange portion shaping-hole, said first and second dies being arranged in this order in an extrusion direction of a molding material and relatively movable along said web shaping-holes, respectively, such that said web shaping-holes of said first and second extrusion holes are in communication with each other and said flange portion shaping-hole of one of said first and second dies is situated on the side of said flange portion communication hole of the other die.

2. A variable section extrusion die set according to claim 1, wherein said first die is formed therein with a hole portion extending in parallel with said web shaping-hole and in a direction substantially perpendicular to an extrusion direction of the molding material, and said second die is slidably inserted in said hole portion.

3. A variable section extrusion die set according to claims 1, wherein said first and second extrusion holes are identical in configuration with each other at said flange shaping-holes and web shaping-holes, and symmetrical with each other with respect to lines parallel to extensions of said flange portion shaping-holes, respectively.

4. A variable section extrusion die set according to claims 1, wherein each said web shaping-holes is formed in and extending from a central portion of an extension of each of said flange portion shaping-holes.

5. A variable section extrusion die set according to claim 2, wherein one of the ends in the thickness direction of each of said first die and said second die is each formed with a bearing portion, said bearing portion having a thin wall and defining a contour of each of said opening portions, said first and second dies being further provided respectively with recesses extending from said bearing portions towards the other ends of said first die and said second die in the thickness direction and having a larger inside diameter than said bearing portions, said first and second dies being arranged such that said bearing portions are disposed adjacent to each other.

6. A variable section extrusion die set according to claim 2, wherein said first and second extrusion holes are identical in configuration with each other at said flange shaping-holes and web shaping-holes, and symmetrical with each other with respect to lines parallel to extensions of said flange portion shaping-holes, respectively.

7. A variable section extrusion die set according to claim 2, wherein each said web shaping-holes is formed in and extending from a central portion of an extension of each said flange portion shaping-holes.

8. A variable section extrusion die set, comprising a first die and a second die, said first die being formed therein with a first extrusion hole, said first extrusion hole including a flange portion shaping-hole having a width equal to a maximum thickness a web shaping-hole extending in a direction substantially perpendicular to said flange portion shaping-hole, said web shaping-hole having first and second end portions said first end portion terminating in said flange portion shaping-hole of said first extrusion hole, and a flange portion communication hole formed in said second end portion of said web shaping-hole and having a larger width than said flange portion shaping-hole, said second die being formed therein with a second extrusion hole, said second extrusion hole including a flange portion shaping-hole having a width equal to said maximum thickness, a web shaping-hole extending in a direction substantially perpendicular to said flange portion shaping-hole said web shaping-hole having third and fourth end portions, said third end portion terminating in said flange portion shaping-hole of said second extrusion hole, and a flange portion communication hole formed in said fourth end portion of said web shaping-hole and having a larger width than said flange portion shaping-hole, said first and second dies being arranged in this order in an extrusion direction of a molding material and relatively movable along said web shaping-holes, respectively, such that said web shaping-holes of said first and second extrusion holes are in communication with each other and said flange portion shaping-hole of one of said first and second dies is situated on the side of said flange portion communication hole of the other die, and wherein one of the ends in the thickness direction of each of said first die and said second die is each formed with a bearing portion, said bearing portion having a thin wall and defining a contour of each of said opening portions, said first and second dies being further provided respectively with recesses extending from said bearing portions towards the other ends of said first die and said second die in the thickness direction and having a larger inside diameter than said bearing portions, said first and second dies being arranged such that said bearing portions are disposed adjacent to each other.

9. A variable set extrusion die set according to claim 8, wherein said first and second extrusion holes are identical in configuration with each other at said flange shaping-holes and web shaping-holes, and symmetrical with each other with respect to lines parallel to extensions of said flange portion shaping-holes, respectively.

10. A variable section extrusion die set comprising a first die, a second die, and a third die, said third die being movable in a direction substantially perpendicular to a relative movement direction of said first and second dies and adapted to adjust a maximum width in a direction substantially perpendicular to the relative movement direction.

said first die being formed therein with a first extrusion hole as said opening portion, said first extrusion hole including a flange shaping-hole having a width equal to a maximum thickness, a web shaping-hole extending in a direction substantially perpendicular to said flange portion shaping-hole, said web shaping-hole having first and second end portions, said first end portion terminating in said flange portion shaping-hole of said first extrusion hole, and a flange portion communication hole formed in said second end portion of said web shaping-hole and having a larger with that said flange portion shaping-hole, said second die being formed therein with a second extrusion hole as said opening portion, said second extrusion hole including a flange portion shaping-hole having a width equal to said maximum thickness, a web shaping-hole extending in a direction substantially perpendicular to said flange portion shaping-hole, said web shaping-hole having a third and forth end portions, said third end portion terminating in said flange portion shaping-hole of said second extrusion hole, and a flange portion communication hole formed in said forth end portion of said web shaping-hole and having a larger width than said flange portion shaping-hole, said first and second dies being relatively movable along said web shaping-holes, respectively, such that said web shaping-holes are in communication with each other and said flange portion shaping-hole of one said first and second dies is situated on the side of said flange potion communication hole of the other die, said third die being disposed outwardly of a distal end in a longitudinal direction of said flange portion shaping-hole and slidable in the longitudinal direction.

11. A variable section extrusion die set according to claim 10, wherein said third die is disposed of outwardly of at least one of opposite ends in the longitudinal direction of said flange portion shaping-hole.

12. A variable section extrusion die set according to claim 4, wherein said first die is provided with a hole portion extending parallel to said web shaping-holes and in the direction substantially perpendicular to the extrusion direction of the molding material and a groove portion extending parallel to said web shaping-holes and in the direction substantially perpendicular to the extrusion direction of the molding material, said second die being slidably inserted into an interior of said hole portion;

said third die being slidably inserted into an interior of said groove portion.

13. A variable section extrusion die set according to claim 11, wherein said first die is provided with a hole portion extending parallel to said web shaping-holes and in the direction substantially perpendicular to the extrusion direction of the molding material and a groove portion extending parallel to said web shaping-holes and in the direction substantially perpendicular to the extrusion direction of the molding material, said second die being slidably inserted into an interior of said hole portion, said third die being slidably inserted into an interior of said groove portion.

14. A variable section extrusion die set according to claim 10, wherein said first and second extrusion holes are identical in configuration with each other at said flange shaping-holes and web shaping-holes, and symmetrical with each other with respect to lines parallel to extensions of said flange portion shaping-holes, respectively.

15. A variable section extrusion die set according to claim 11, wherein said first and second extrusion holes are identical in configuration with each other at said flange shaping-holes and web shaping-holes, and symmetrical with each other with respect to lines parallel to extensions of said flange portion shaping-holes, respectively.

16. A variable section extrusion die set according to claim 12, wherein said first and second extrusion holes are identical in configuration with each other at said flange shaping-holes and web shaping-holes, and symmetrical with each other with respect to lines parallel to extensions of said flange portion shaping-holes, respectively.

17. A variable section extrusion molding method for use with a variable section extrusion die set comprising: a first die and a second die, said first die being formed therein with a first extrusion hole, said first extrusion hole including a flange portion shaping-hole having a width equal to a maximum thickness, a web shaping-hole extending in a direction substantially perpendicular to said flange portion shaping-hole, said web shaping-hole having first and second end portions said first end portion terminating in said flange portion shaping-hole of said first extrusion hole, and a flange portion communication hole formed in said second end portion of said web shaping-hole and having a larger width than said flange portion shaping-hole, said second die being formed therein with a second extrusion hole, said second extrusion hole including a flange portion shaping-hole having a width equal to said maximum thickness, a web shaping-hole extending in a direction substantially perpendicular to said flange portion shaping-hole, said web shaping-hole having third and fourth and portions said third end portion terminating in said flange portion shaping-hole of said second extrusion hole and a flange portion communication hole formed in said fourth end portion of said web shaping-hole and having a larger width than said flange portion shaping-hole, said first and second dies being arranged in this order in an extrusion direction of a molding material and relatively movable along said web shaping-holes, respectively, such that said web shaping-holes of said first and second extrusion holes are in communication with each other and said flange portion shaping-hole of one of said first and second dies is situated on the side of said flange portion communication hole of the other die;

the method comprising the steps of:

relatively moving said first and second dies while extruding the molding material towards said variable section extrusion die set, performing an extruding operation at at least two of the following positions:

a first position whereat said web shaping-holes of said first and second extrusion holes being in communication with each other and said flange portion shaping-holes not being in communication with said flange portion communication hole of the other die;

a second position whereat said web shaping-holes of said first and second extrusion holes being in communication with each other and a part of one of said flange shaping-hole being in communication with said flange portion communication hole of the other die; and a third position whereat said web shaping-holes of said first and second extrusion holes being in communication with each other and an entirety of one of said flange shaping-holes being in communication with said flange portion communication hole of the other die, thereby extruding a molded article which varies in cross sectional configuration in the longitudinal direction.

18. A variable section extrusion molding method for use with a variable section extrusion die set comprising: a first die, a second die and a third die, said third die being movable in a direction substantially perpendicular to a relative movement direction of said first and second dies and adapted to adjust a maximum width in a direction perpendicular to the relative movement direction, said first die being formed therein with a first extrusion hole as said opening portion, said first extrusion hole including a flange portion shaping-hole having a width equal to a maximum thickness, a web shaping-hole extending in a direction substantially perpendicular to said flange portion shaping-hole, said web shaping-hole having first and second end portions, said first end portion terminating in said flange portion shaping-hole of said first extension hole, and a flange portion communication hole formed in said second end portion of said web shaping-hole and having a larger width than said flange portion shaping-hole, said second die being formed therein with a second extrusion hole as said opening portion, said second extrusion hole including a flange portion shaping-hole having a width equal to said maximum thickness, a web shaping-hole extending in a direction substantially perpendicular to said flange portion shaping-hole, said web shapinghole having third and fourth end portions said third end portion terminating in said flange portion shaping-hole of said second extrusion hole, and a flange portion communication hole formed in said fourth end portion of said web shaping-hole and having a larger width than said flange portion shaping-hole, said first and second dies being relatively movable along said web shaping-holes, respectively, such that said web shaping-holes are in communication with each other and said flange portion shaping-hole of one of said first and second dies is situated on the side of said flange portion communication hole of the other one of said first and second dies, said third die being disposed outwardly of a distal end in a longitudinal direction of said flange portion shaping-hole and slidable in the longitudinal direction;

the method comprising the steps of:

relatively moving said first and second dies while extruding the molding material towards said variable section extrusion die set, performing an extruding operation at at least one of the following positions:

a first position whereat said web shaping-holes of said first and second extrusion holes being in communication with each other and a part of one of said flange shaping-holes being in communication with said flange portion communication hole of the other die, and a second position where said web shaping-holes of said first and second extrusion holes being in communication with each other and an entirety of one of said flange shaping-holes being in communication with said flange portion communication hole of the other die, at that time, a length of each of said flange portion shaping-holes being adjusted by said third die, thereby extruding a molded article which varies in cross sectional configuration in the longitudinal direction.

19. A variable section extrusion molding method for producing a molded article which varies in cross sectional area in an extruding direction by varying an opening area of a die hole using a variable means while extruding a molding material, the molding material being fed into a container by a pressing means, the method comprising:

preliminarily setting a rate of variation of said opening area of said die hole with respect to the length of said molding, and an amount of extrusion of the molding material by said pressing means, in a control means, and controlling, by said control means, an amount of variation of said opening area caused by said variable means such that the length of extrusion of said molding and said opening area corresponds to an amount of movement of said pressing means, while detecting said amount of movement of said pressing means when said extrusion molding is performed.

20. A variable section extrusion molding method according to claim 19, wherein said pressing means is a ram for pressing the molding material, and a variation equation, $A=f(z)$, of said opening area A against a sectional area D of said container and a length z of said molding is preliminarily input to said control means, and then an amount of variation of said opening area by means of said variable means is controlled by said control means so that said molding is controlled to have an extrusion length dz and an area A corresponding to said dx calculated based on $D \cdot dx=f(z) \cdot dz$ and an area A by said control means in response to a detection signal of a movement dx of said ram from x.

* * * * *